US011324080B2

(12) United States Patent
Kim et al.

(10) Patent No.: US 11,324,080 B2
(45) Date of Patent: May 3, 2022

(54) INDUCTION HEATING COOKING DEVICE

(71) Applicant: Samsung Electronics Co., Ltd., Suwon-si (KR)

(72) Inventors: Hee Sup Kim, Suwon-si (KR); Han Seong Kang, Hwaseong-si (KR); Jong Sung Park, Seoul (KR); Jung Kwon Kim, Seoul (KR); Hyung Jin Kim, Ansan-si (KR); Pung Yeun Cho, Suwon-si (KR); Yeon A Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/021,237

(22) Filed: Sep. 15, 2020

(65) Prior Publication Data

US 2020/0413498 A1 Dec. 31, 2020

Related U.S. Application Data

(62) Division of application No. 15/315,204, filed as application No. PCT/KR2015/004987 on May 19, 2015, now Pat. No. 10,805,989.

(30) Foreign Application Priority Data

May 30, 2014 (KR) ..... 10-2014-0066319

(51) Int. Cl.
*H05B 6/12* (2006.01)
*F24C 15/10* (2006.01)
*H05B 6/02* (2006.01)

(52) U.S. Cl.
CPC ..... *H05B 6/1218* (2013.01); *F24C 15/10* (2013.01); *H05B 6/12* (2013.01); *H05B 6/1236* (2013.01);
(Continued)

(58) Field of Classification Search
CPC . H05B 6/02; H05B 6/062; H05B 6/12; H05B 6/1209; H05B 6/1218;
(Continued)

(56) References Cited

U.S. PATENT DOCUMENTS

2003/0192881 A1 10/2003 Bassill et al.
2005/0242085 A1 11/2005 Kaji et al.
(Continued)

FOREIGN PATENT DOCUMENTS

CN 1445481 A 10/2003
CN 100531479 8/2009
(Continued)

OTHER PUBLICATIONS

Written Opinion (Form PCT/ISA/237); dated Jul. 24, 2015 in corresponding International Patent Application No. PCT/KR2015/004987 (5 pages).
(Continued)

*Primary Examiner* — Hung D Nguyen
(74) *Attorney, Agent, or Firm* — Staas & Halsey LLP

(57) ABSTRACT

An induction heating cooking device includes a cooking table having an auxiliary slit; an induction coil for generating a magnetic field so as to inductively heat a cooking container placed on the cooking table; multiple light sources disposed at the outside of the induction coil; and a main slit through which light emitted from the light sources passes. The induction heating cooking device forms a virtual flame image on the cooking container, thereby enabling the heating state of the induction heating cooking device to be intuitively checked.

7 Claims, 26 Drawing Sheets

(52) U.S. Cl.
CPC ..... *H05B 6/1245* (2013.01); *H05B 6/02* (2013.01); *H05B 2206/022* (2013.01)

(58) Field of Classification Search
CPC ..... H05B 6/1236; H05B 6/1245; H05B 2206/022; F24C 15/10; F24C 15/102
USPC ..... 219/620, 622, 626, 664, 665, 672, 675, 219/676
See application file for complete search history.

(56) References Cited

U.S. PATENT DOCUMENTS

| | | | | |
|---|---|---|---|---|
| 2006/0091135 | A1 | 5/2006 | Kondo et al. | |
| 2012/0118281 | A1 | 5/2012 | Shigeoka et al. | |
| 2013/0098901 | A1 | 4/2013 | Corleoni | |
| 2013/0229788 | A1 | 9/2013 | Hoffman et al. | |
| 2015/0013660 | A1* | 1/2015 | Holzinger | F24C 7/083 219/460.1 |
| 2016/0258631 | A1* | 9/2016 | Aihara | C03C 17/44 |

FOREIGN PATENT DOCUMENTS

| | | | | |
|---|---|---|---|---|
| CN | 101682944 | | 3/2010 | |
| CN | 102474920 | | 5/2012 | |
| CN | 103119372 | | 5/2013 | |
| EP | 2 458 935 | A1 | 5/2012 | |
| JP | 2003-257601 | | 9/2003 | |
| JP | 2003272815 | A * | 9/2003 | H05B 6/1218 |
| JP | 2010-257579 | | 11/2010 | |
| JP | 2011-96493 | | 5/2011 | |
| KR | 2003-0074065 | | 9/2003 | |
| WO | WO 02/17684 | A2 | 2/2002 | |
| WO | 2013/149792 | | 10/2013 | |
| WO | WO 2015/182911 | A1 | 12/2015 | |

OTHER PUBLICATIONS

International Search Report (Form PCT/ISA/210); dated Jul. 24, 2015 in corresponding International Patent Application No. PCT/KR2015/004987 (4 pages) (3 pages English Translation).
Canadian Office Action dated Sep. 29, 2017 in corresponding Canadian Application No. 2,950,886, 4 pgs.
Extended European Search Report dated Feb. 1, 2018 in corresponding European Patent Application No. 15799635.6, 4 pgs.
Canadian Office Action dated Sep. 28, 2018 in Canadian Patent Application No. 2,950,886.
Chinese Office Action dated Jan. 18, 2019 in Chinese Patent Application No. 201580038860.7.
Japanese Office Action dated Jul. 30, 2019 in corresponding Japanese Patent Application No. 2017-515643.
Canadian Office Action dated Jun. 28, 2019 in corresponding Canadian Patent Application No. 2,950,886.
Indian Office Action dated Sep. 30, 2019 in Indian Patent Application No. 201627040840.
Chinese Office Action dated Sep. 17, 2019 in Chinese Patent Application No. 201580038860.7.
Japanese Office Action dated Mar. 10, 2020 in Japanese Patent Application No. 2017-515643.
Korean Office Action dated Feb. 20, 2020 in Korean Patent Application No. 10-2014-0066319.
Canadian Office Action dated May 28, 2020 in Canadian Patent Application No. 2,950,886.
U.S. Office Action dated Apr. 8, 2019 in U.S. Appl. No. 15/315,204.
U.S. Office Action dated Sep. 6, 2019 in U.S. Appl. No. 15/315,204.
U.S. Office Action dated Jan. 8, 2020 in U.S. Appl. No. 15/315,204.
U.S. Notice of Allowance dated Jun. 8, 2020 in U.S. Appl. No. 15/315,204.
U.S. Appl. No. 15/315,204, filed Nov. 30, 2016, Hee Sup Kim, Samsung Electronics Co., Ltd.

* cited by examiner

[Fig. 1]
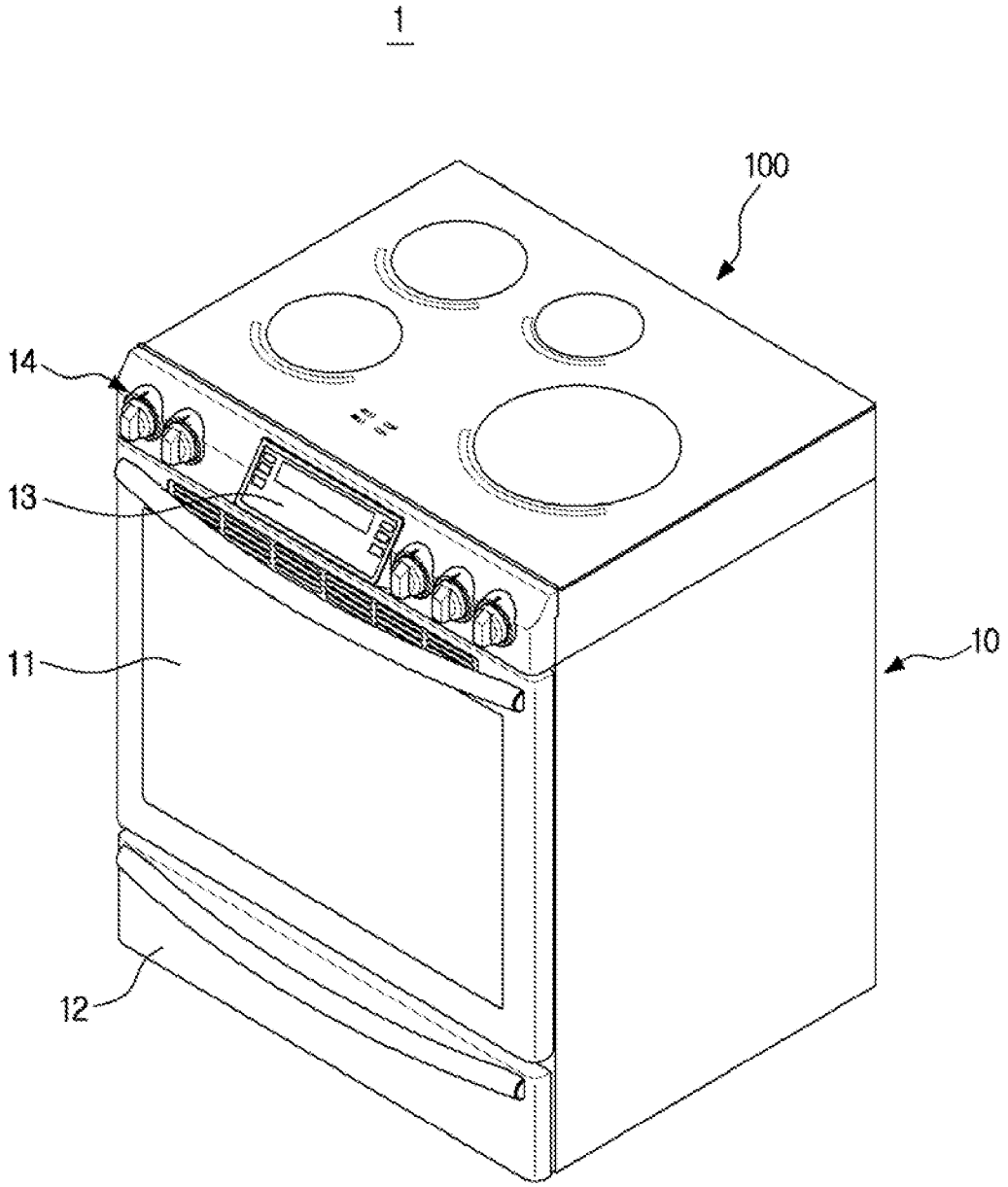

[Fig. 2]
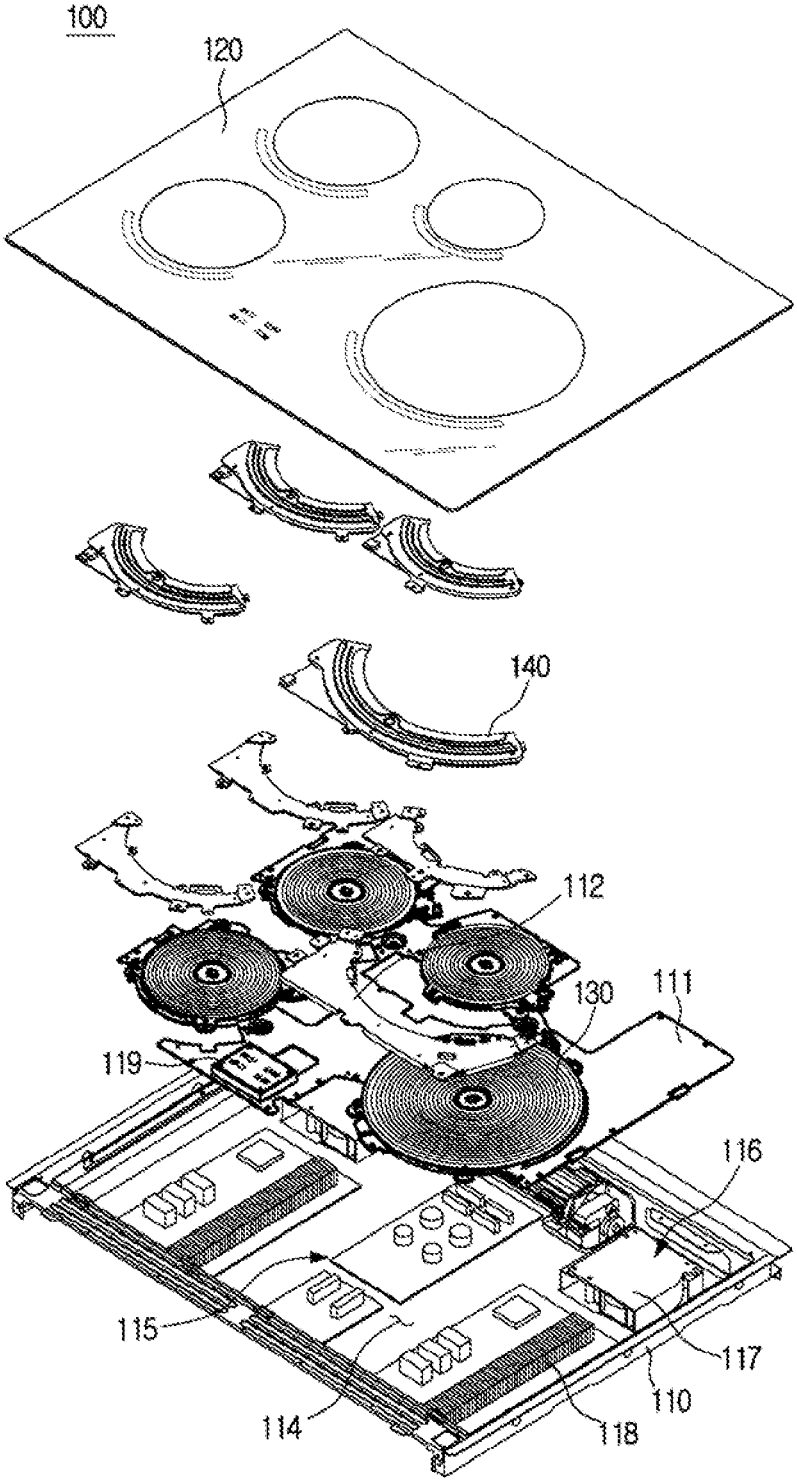

[Fig. 3]
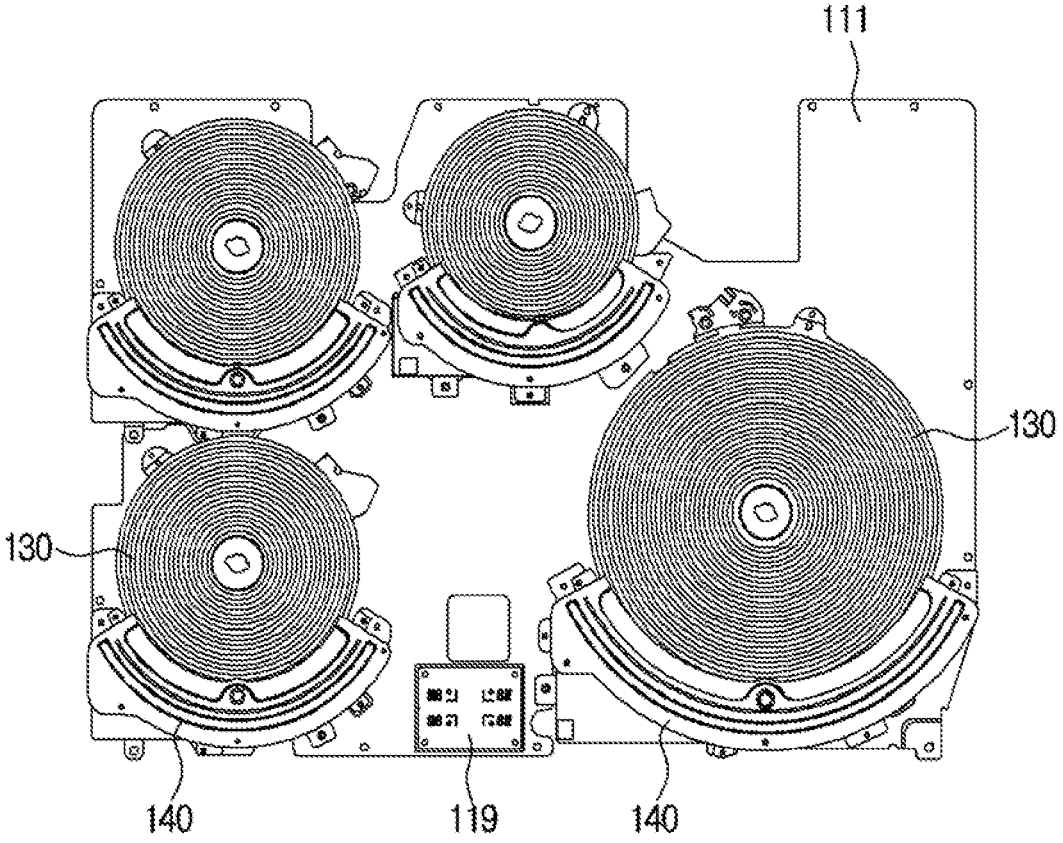

[Fig. 4]
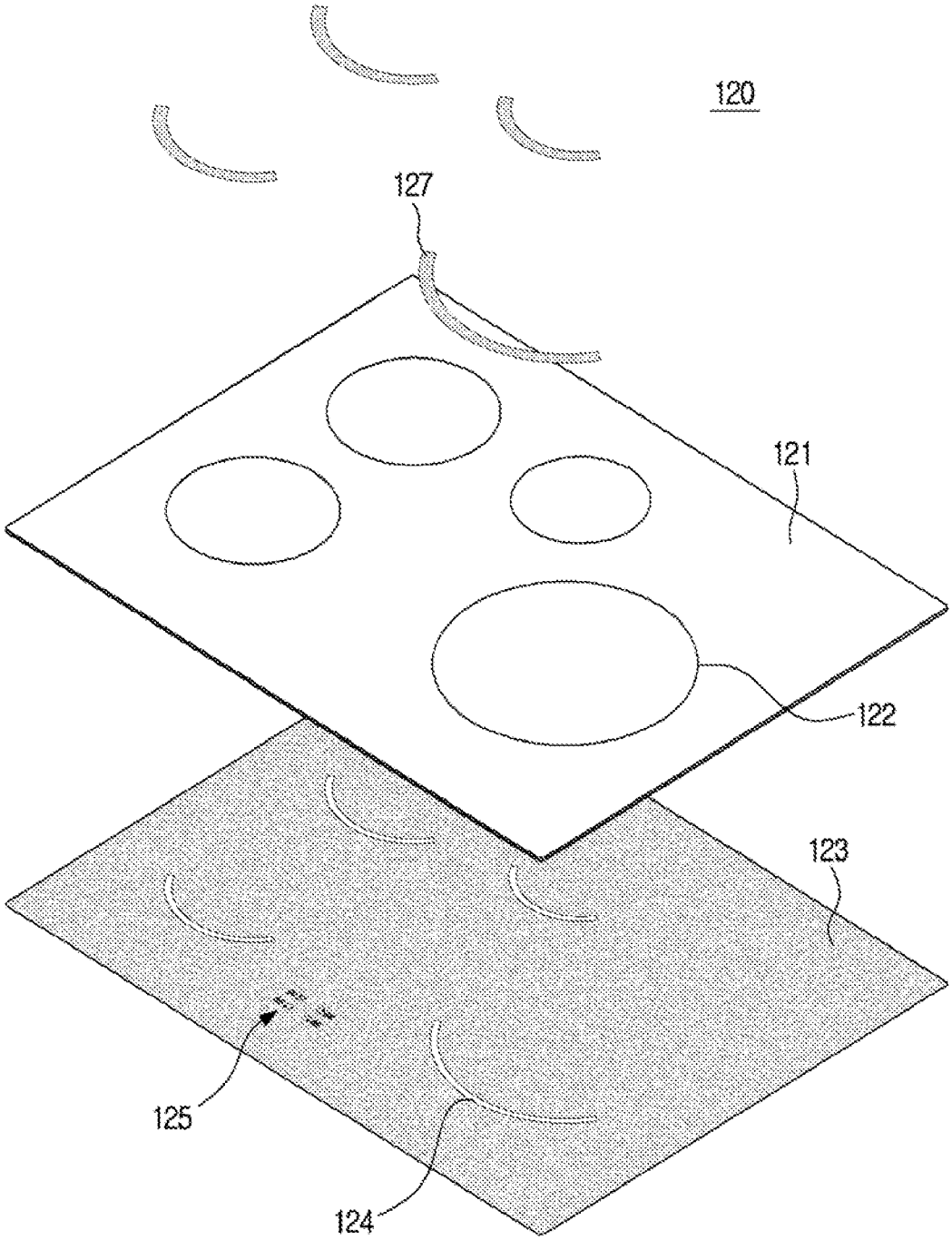

[Fig. 5]
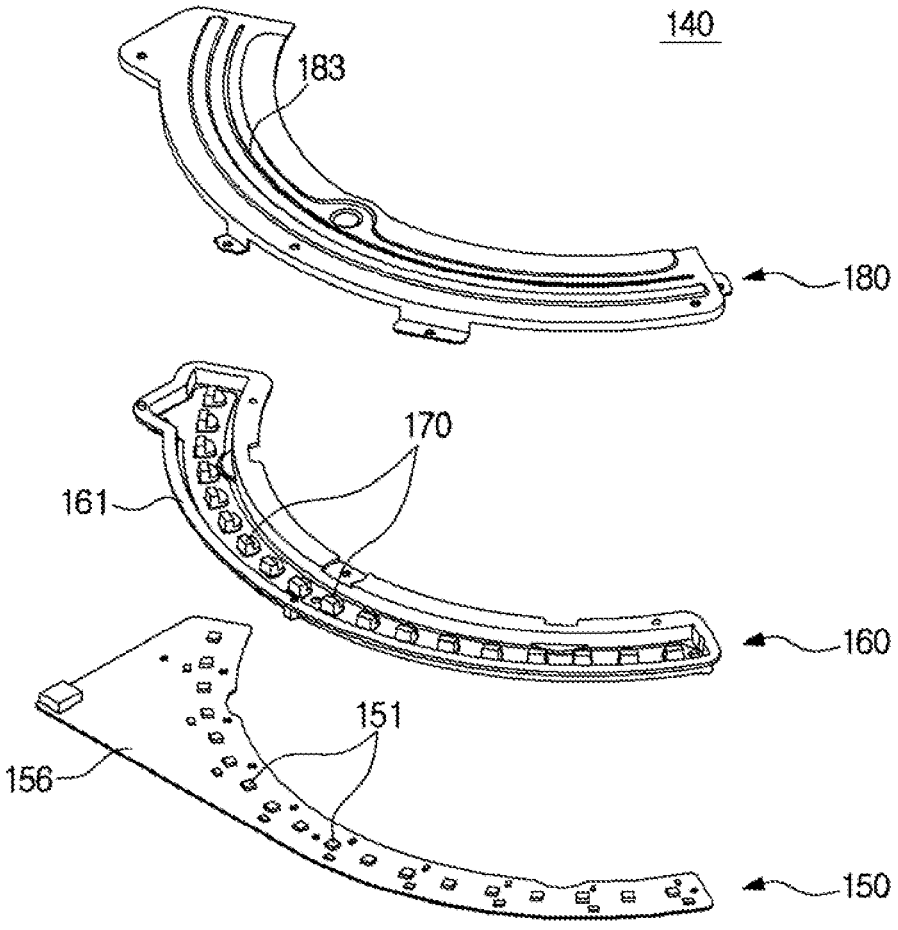

[Fig. 6]
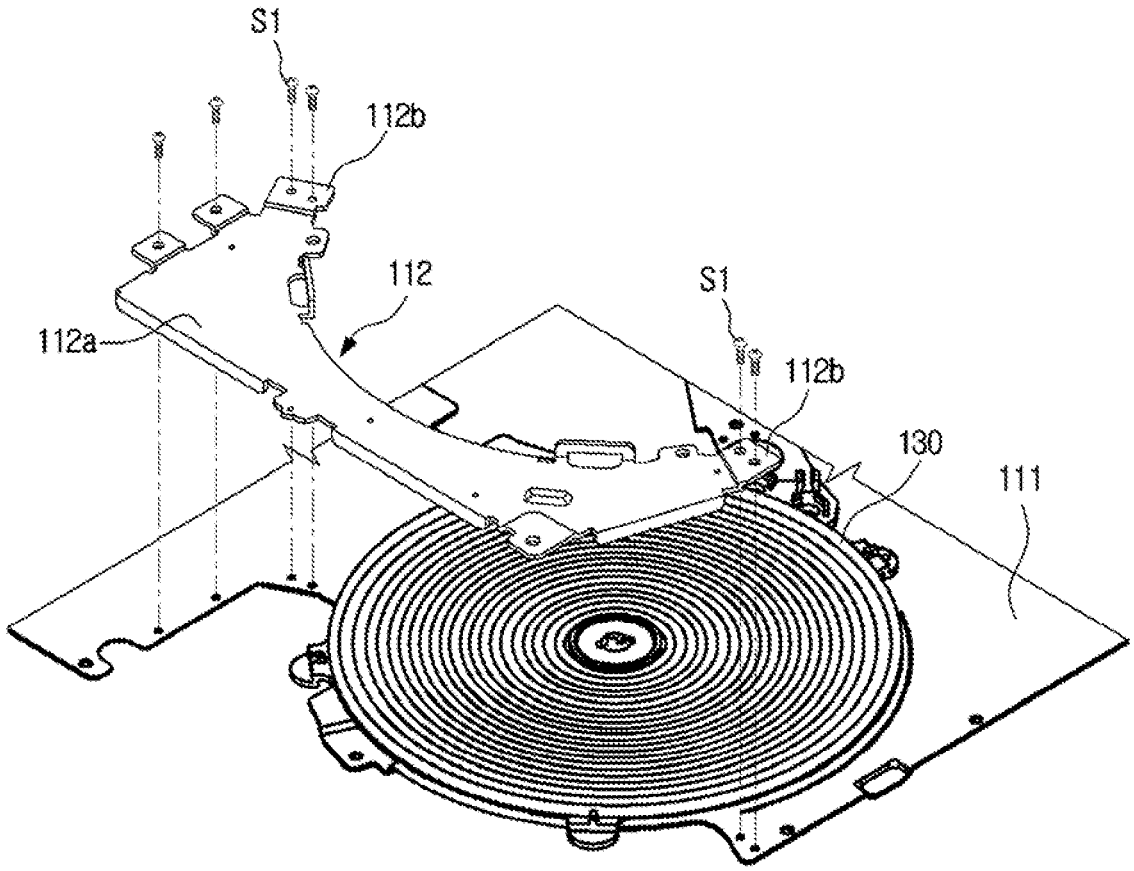

[Fig. 7]
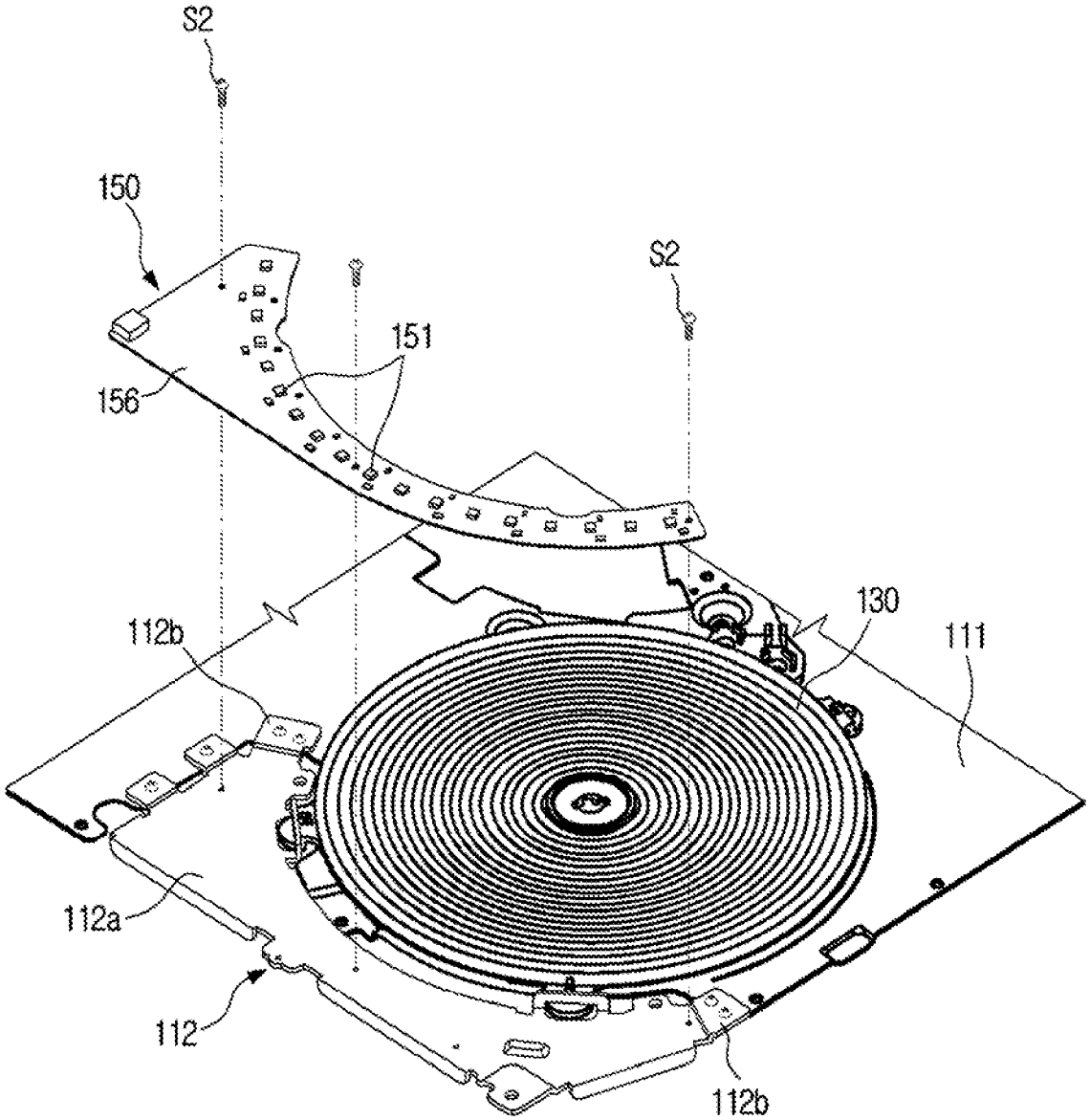

[Fig. 8]
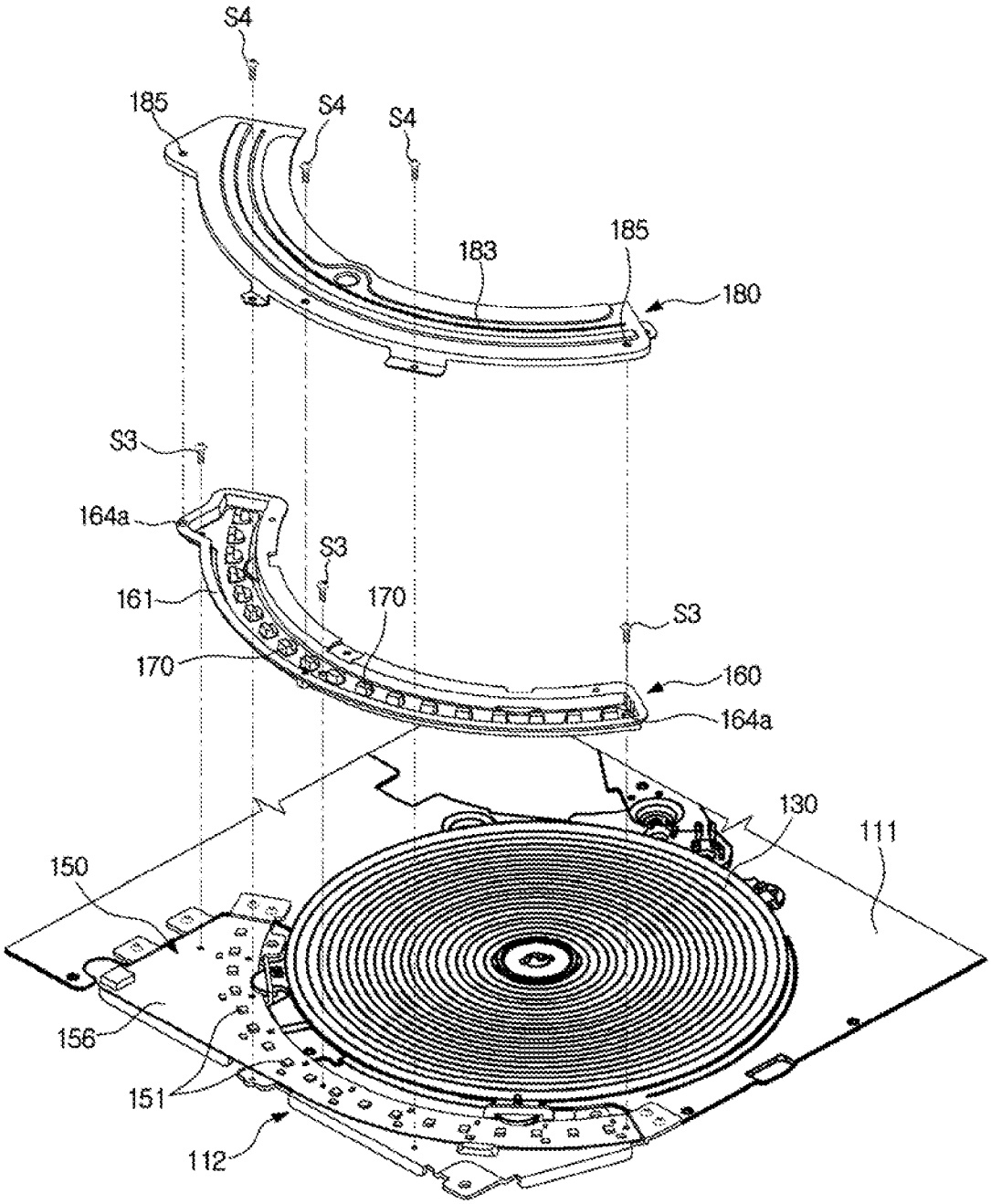

[Fig. 9]
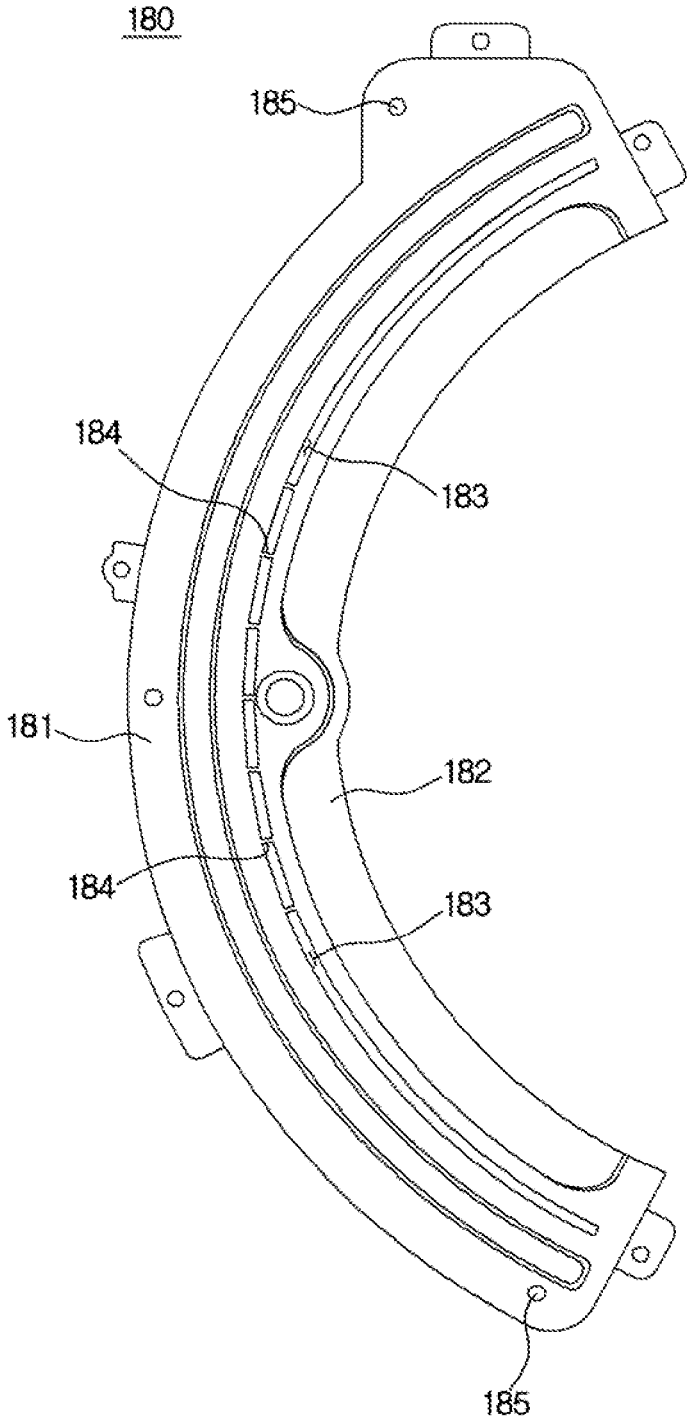

[Fig. 10]
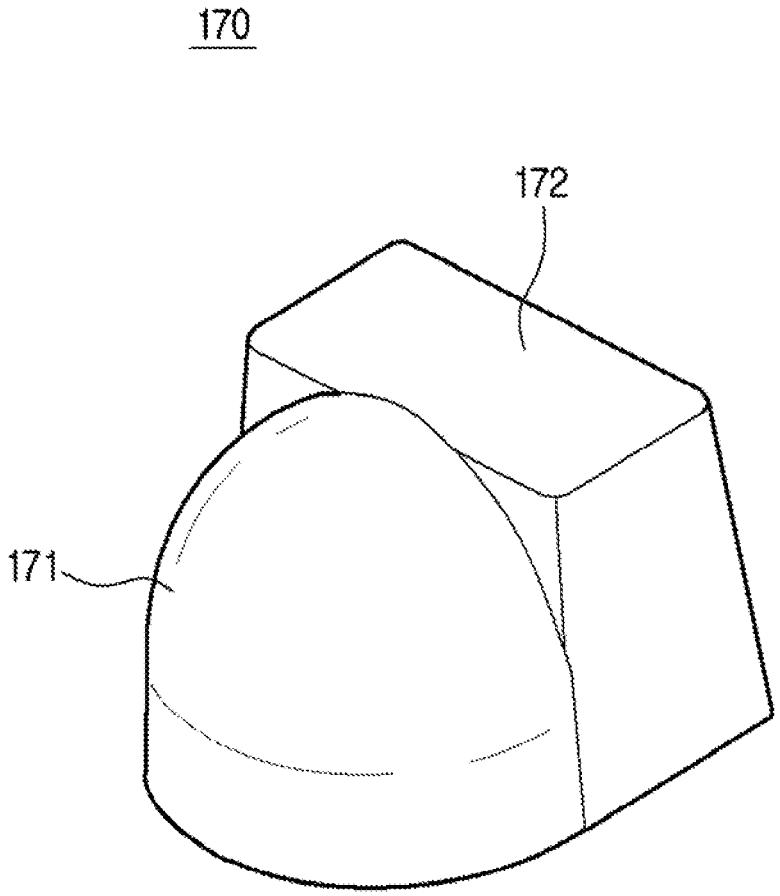

[Fig. 11]
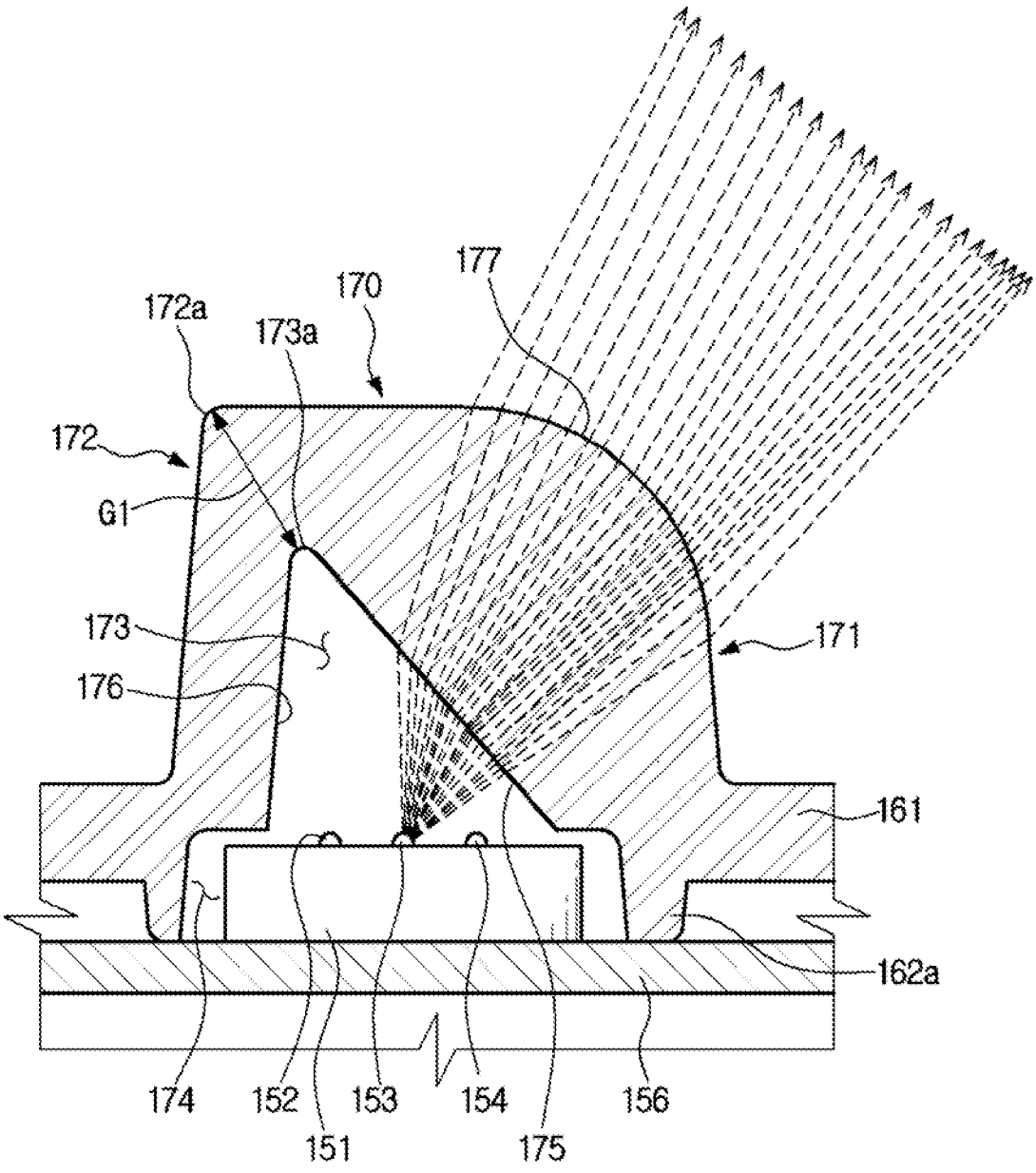

[Fig. 12]
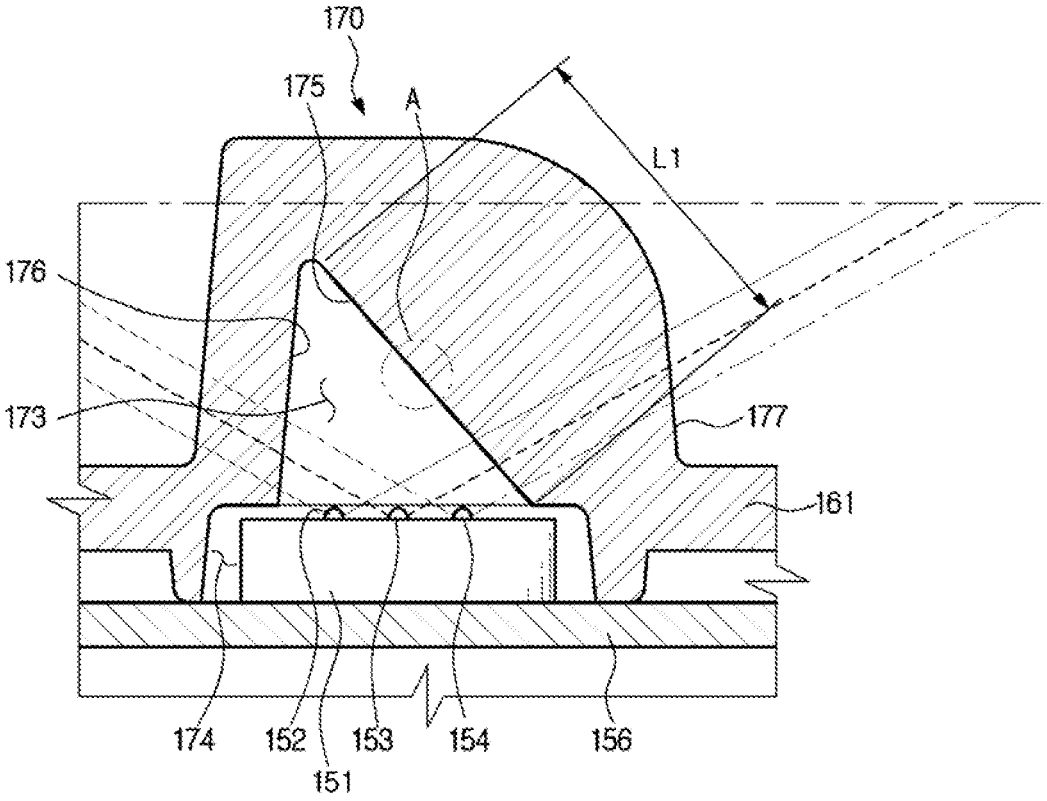

[Fig. 13]
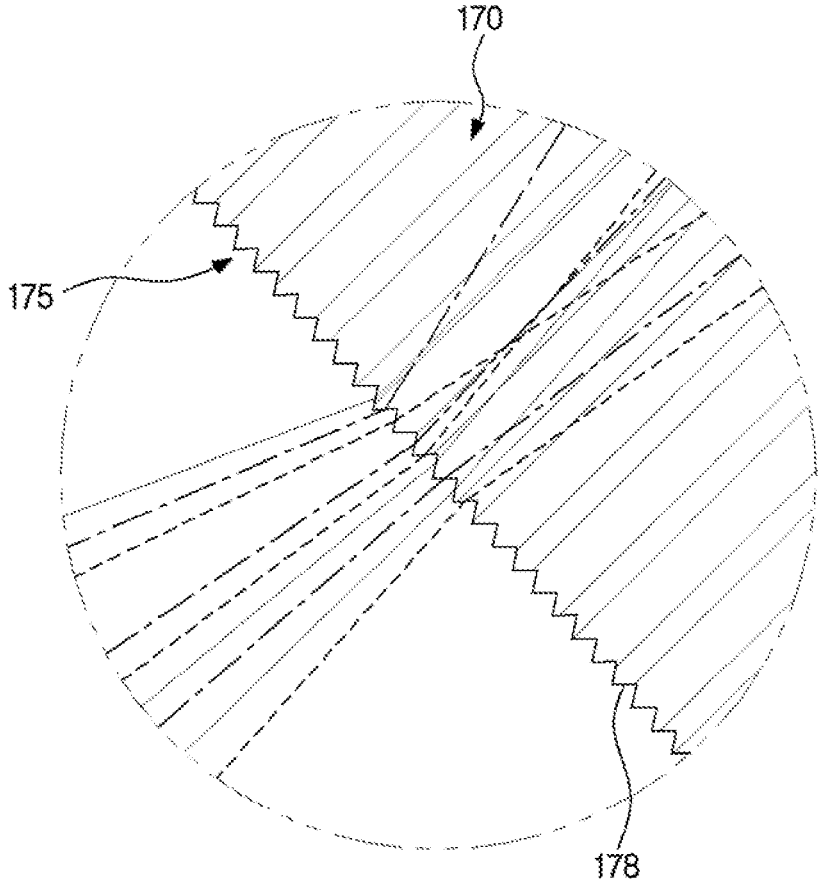

[Fig. 14]
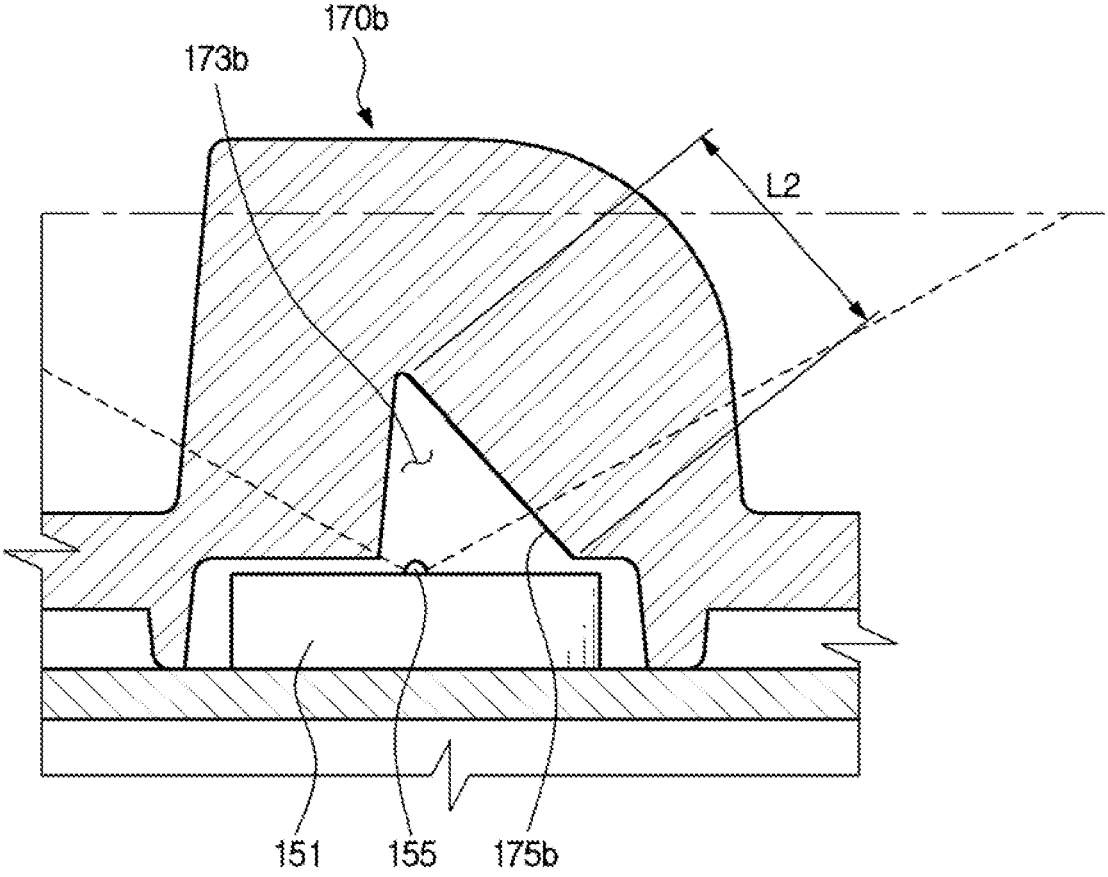

[Fig. 15]
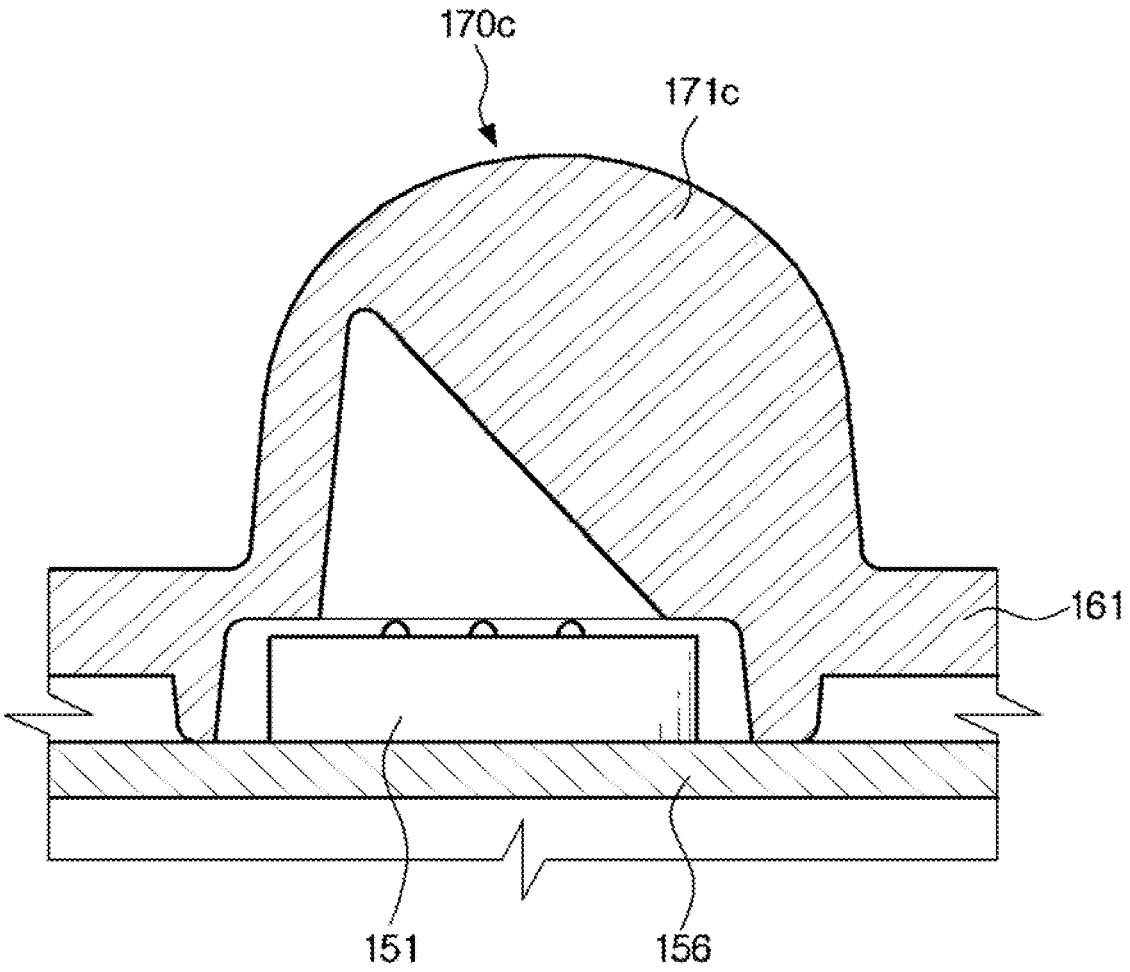

[Fig. 16]
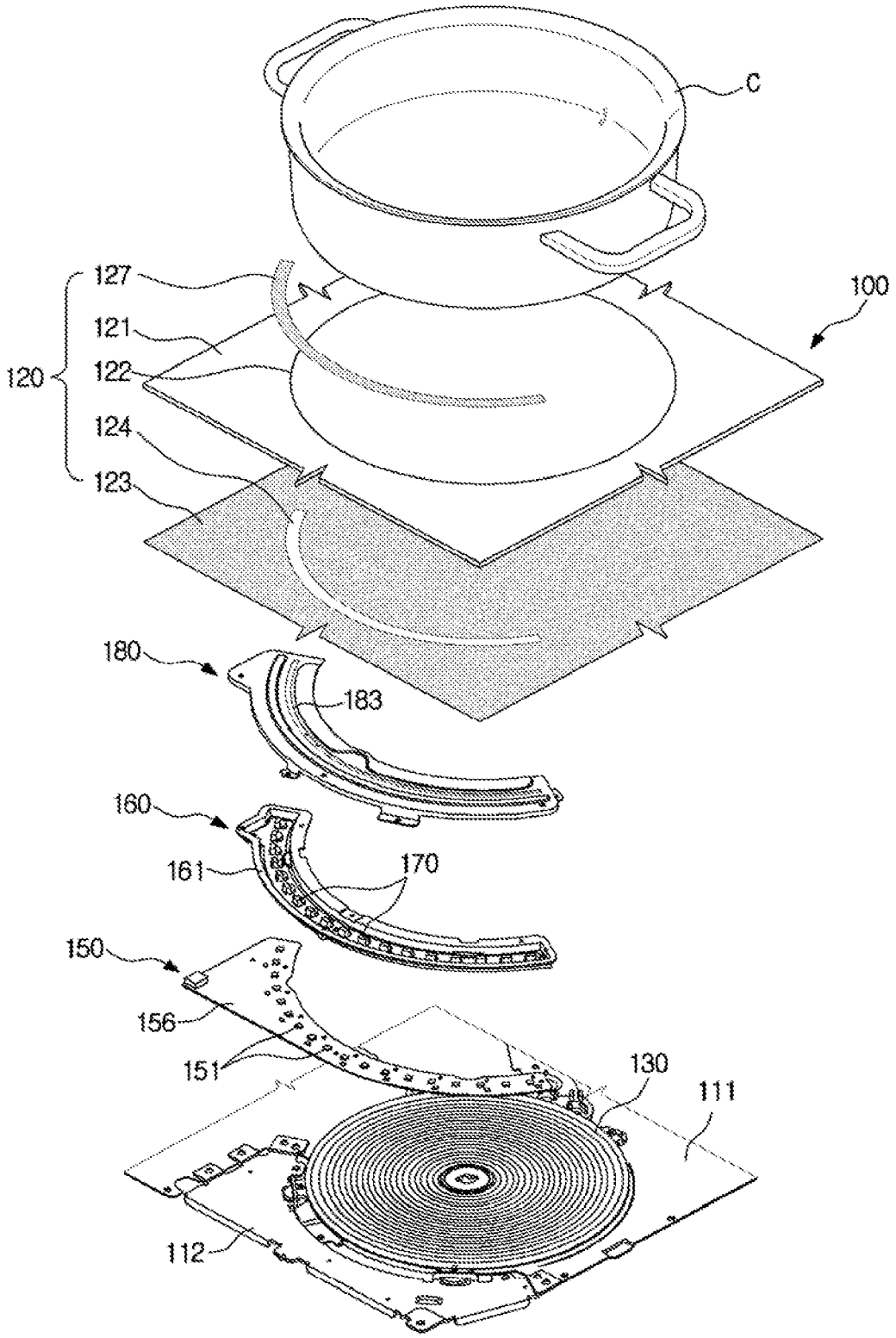

[Fig. 17]
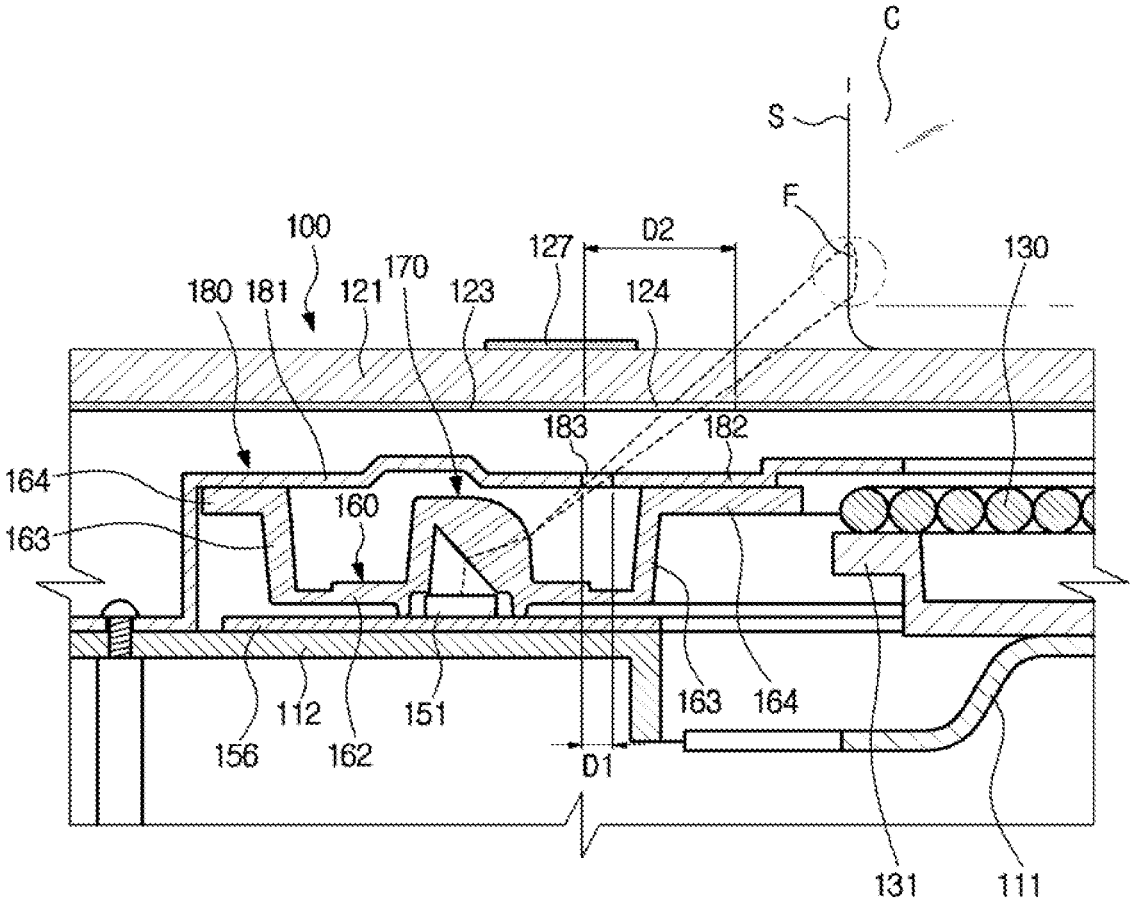

[Fig. 18]
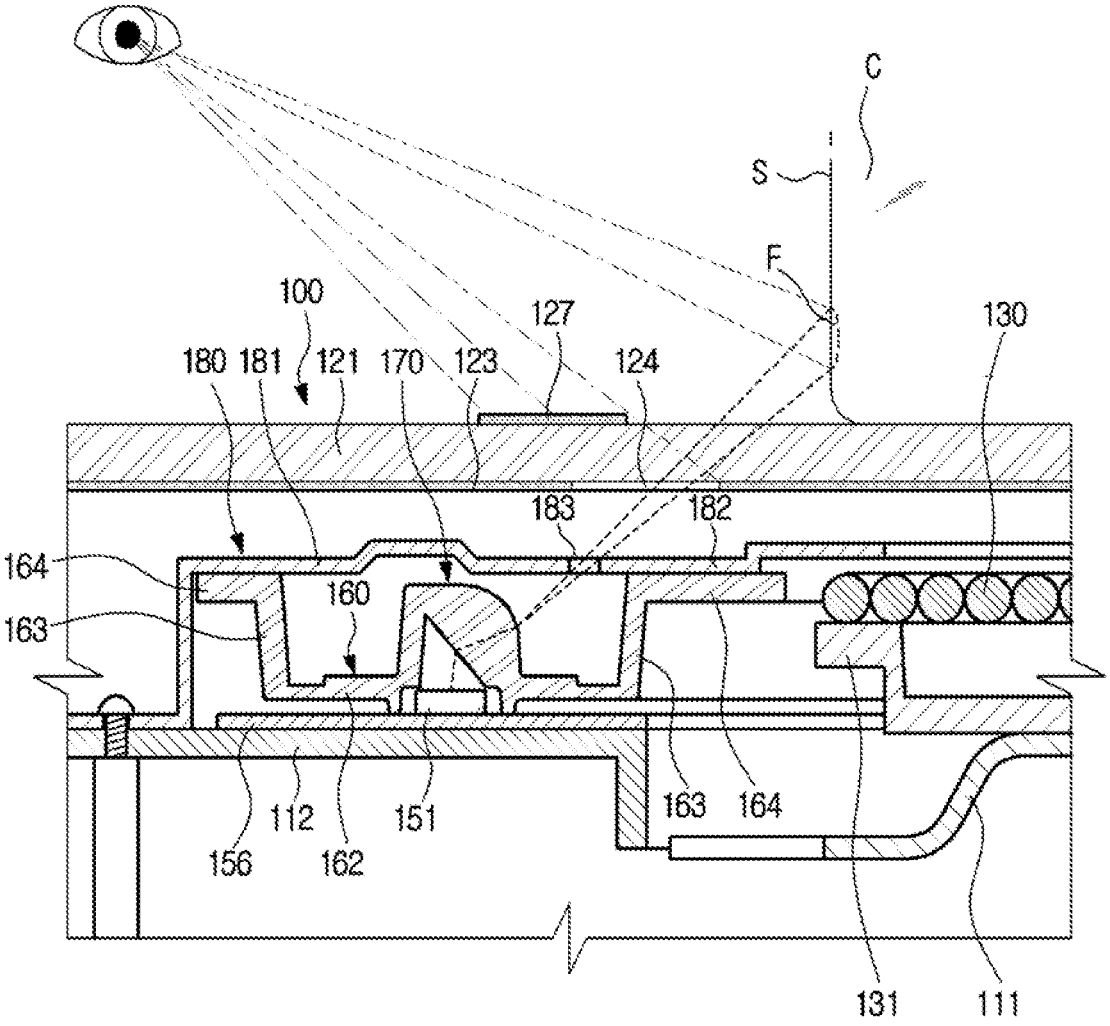

[Fig. 19]
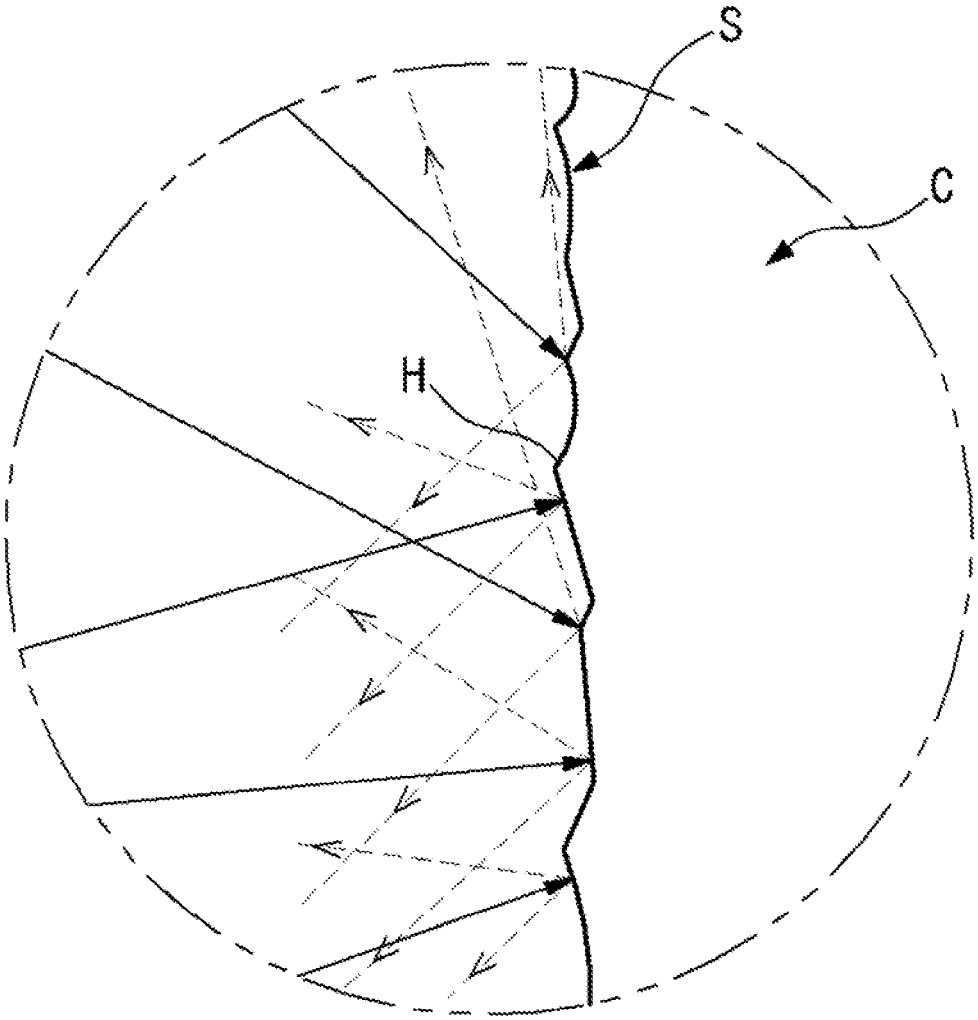

[Fig. 20]
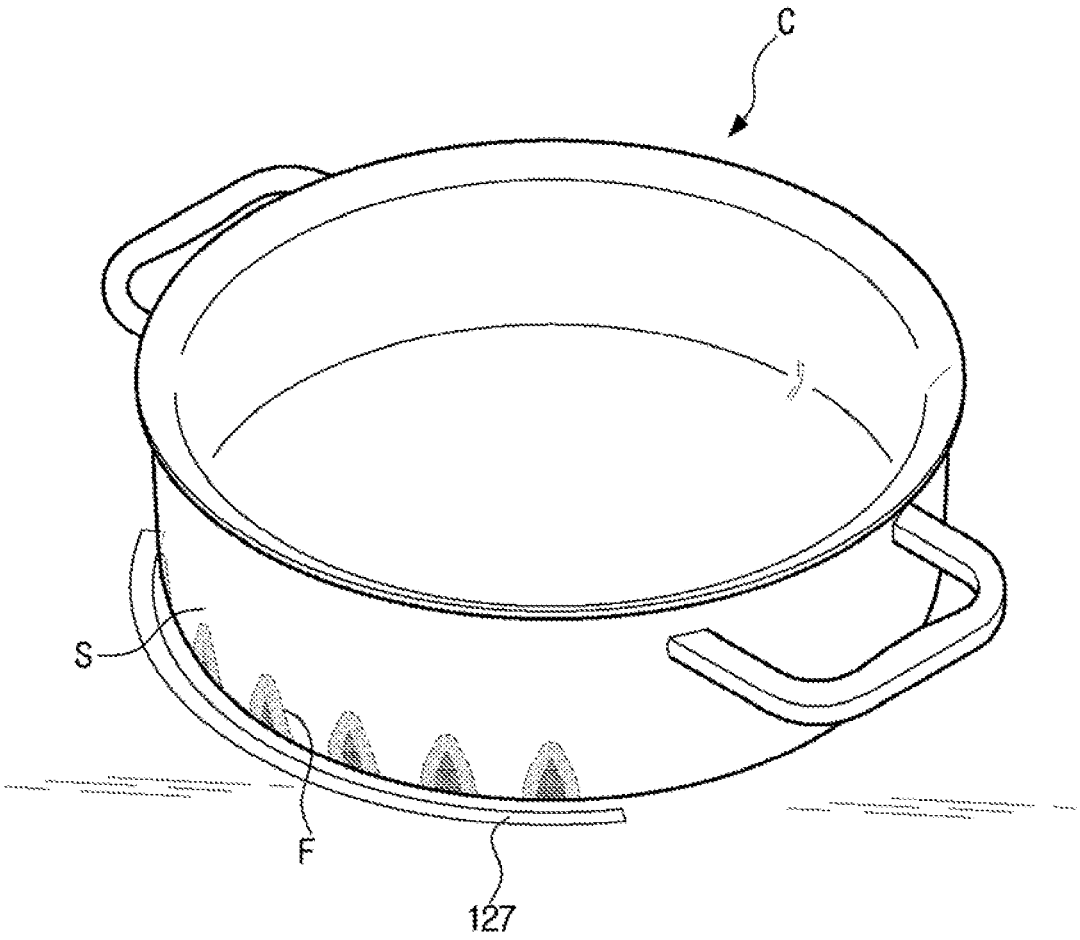

[Fig. 21]
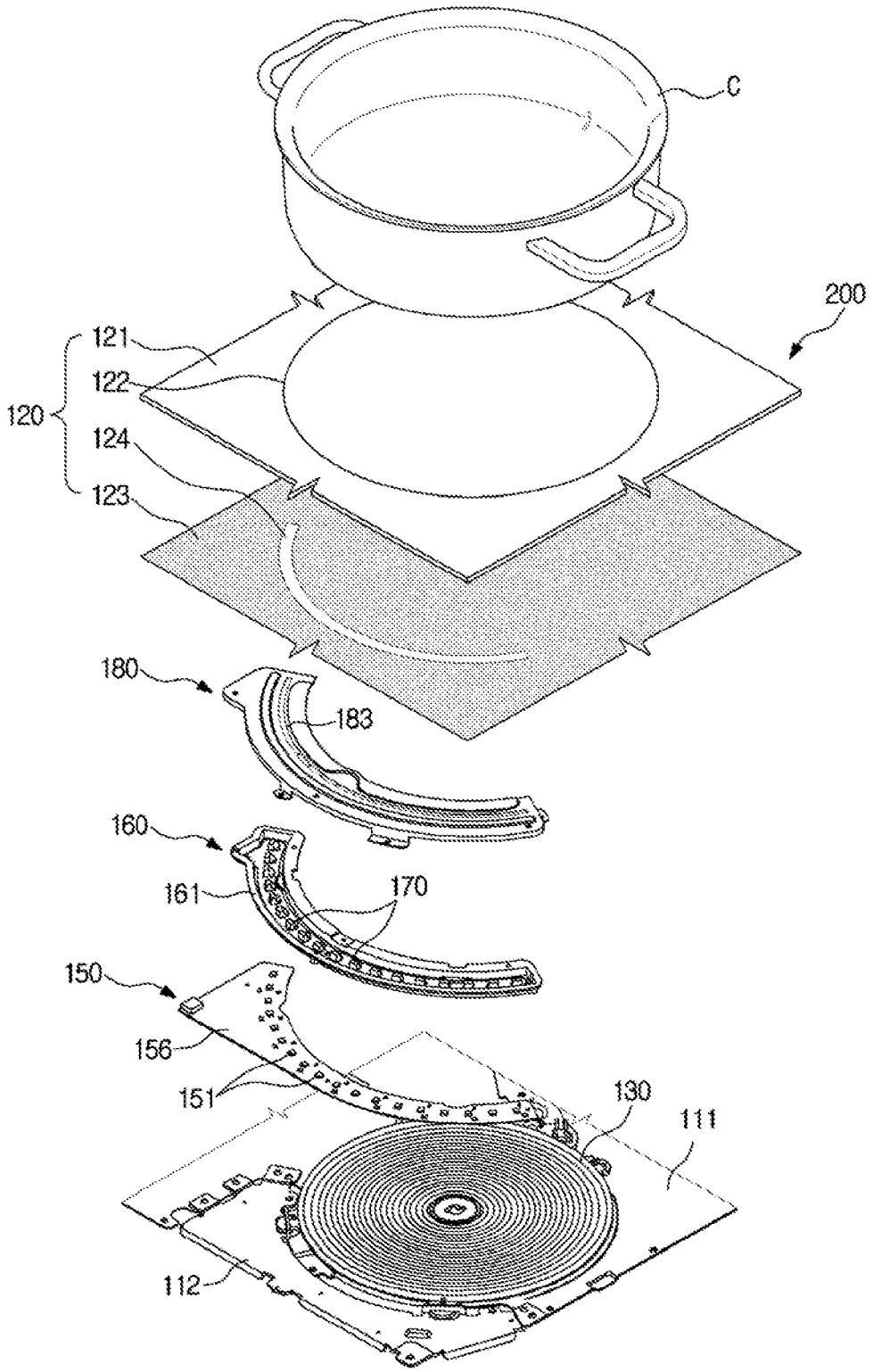

[Fig. 22]
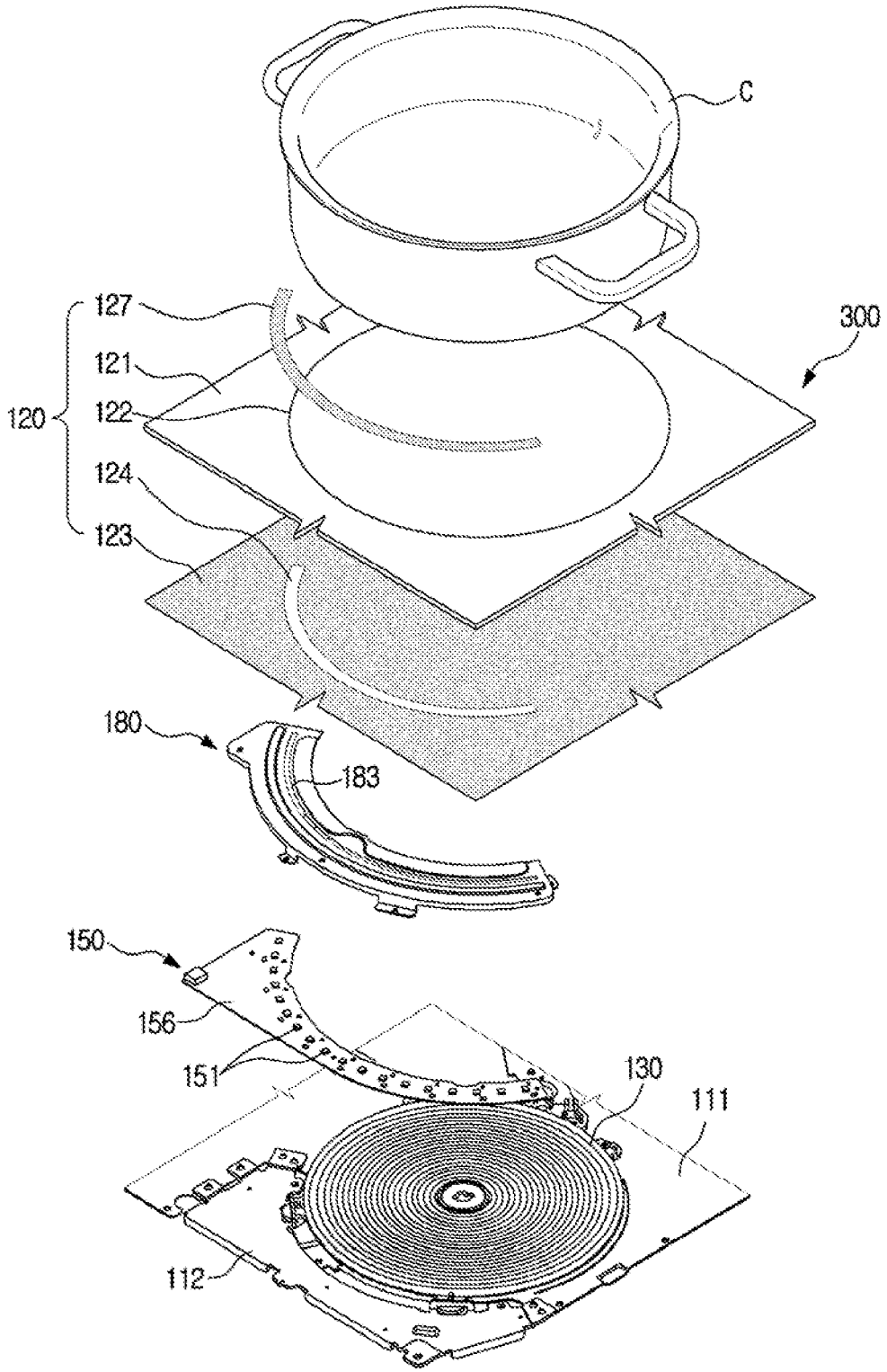

[Fig. 23]
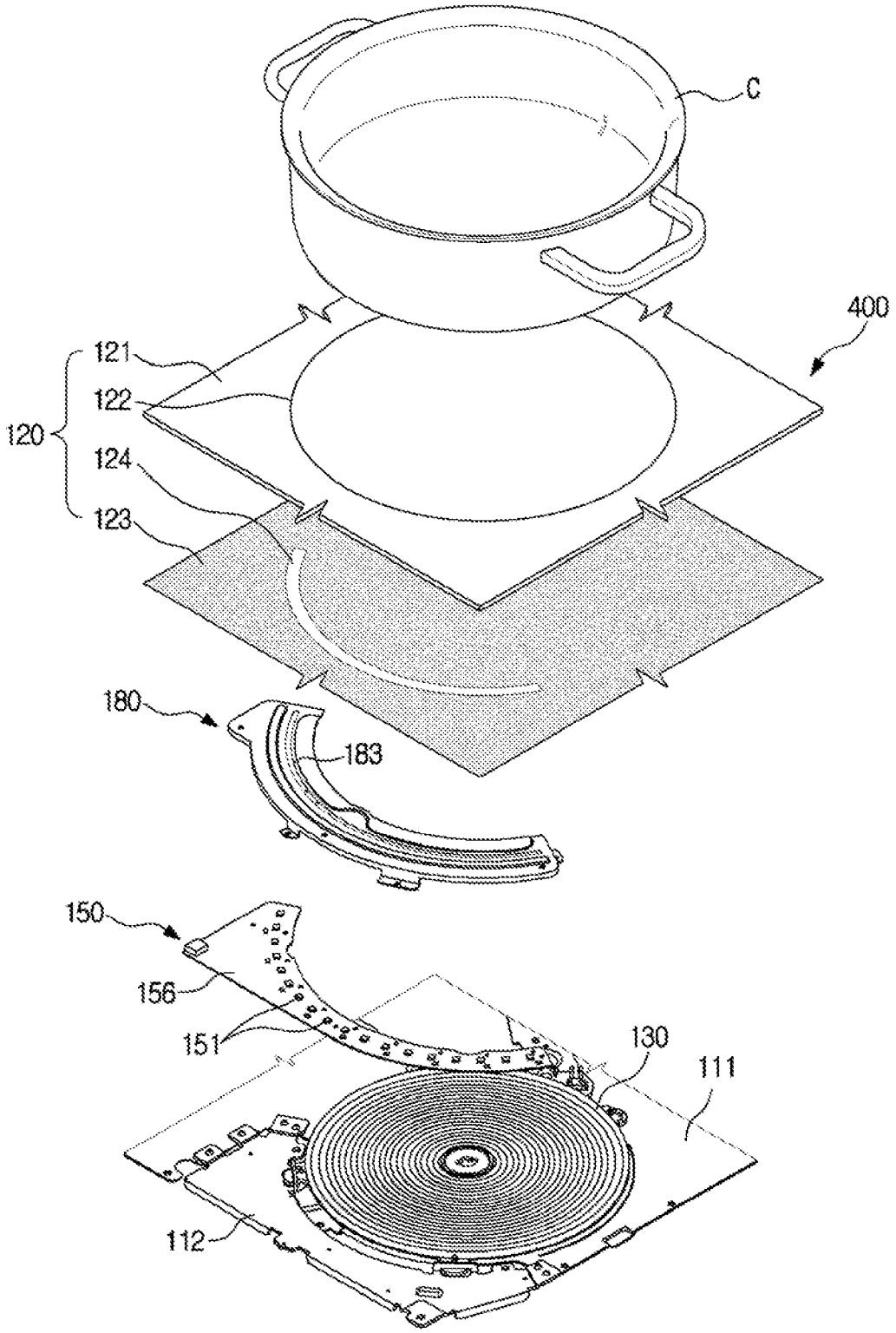

[Fig. 24]
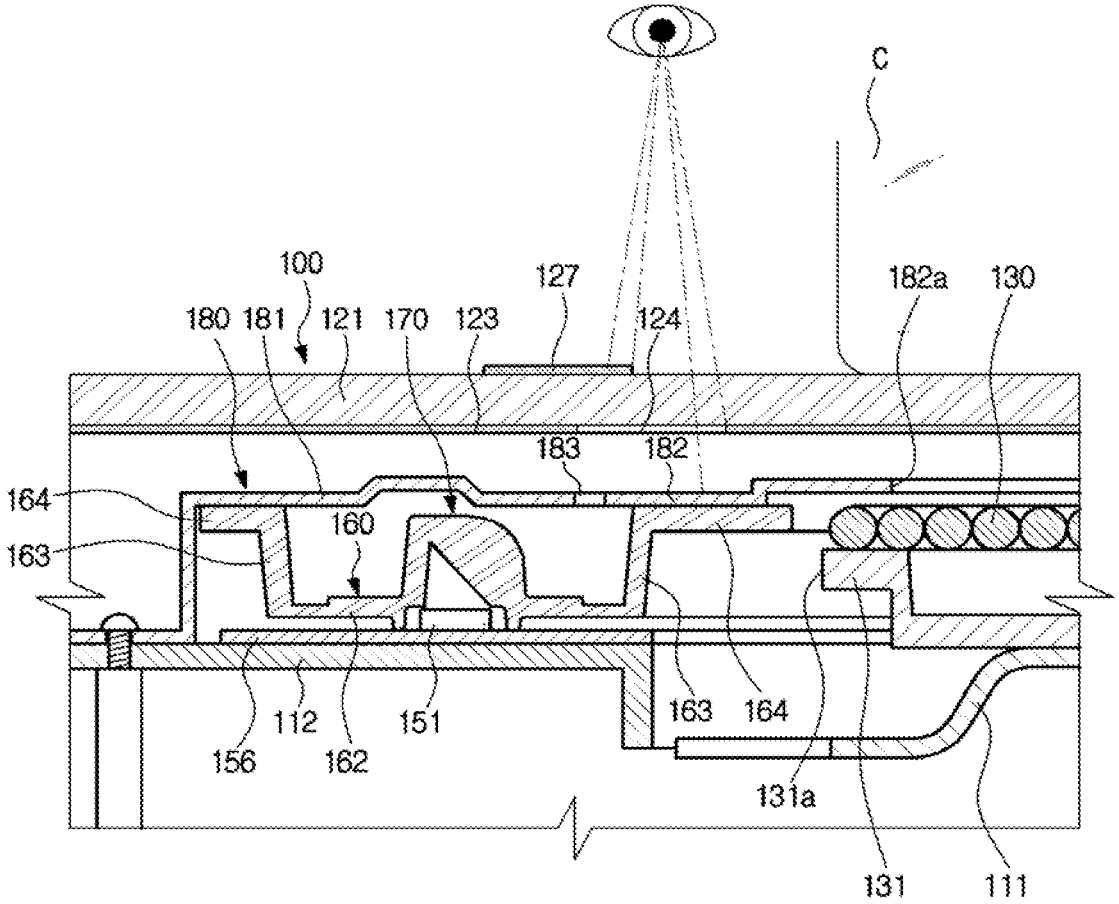
[Fig. 25]
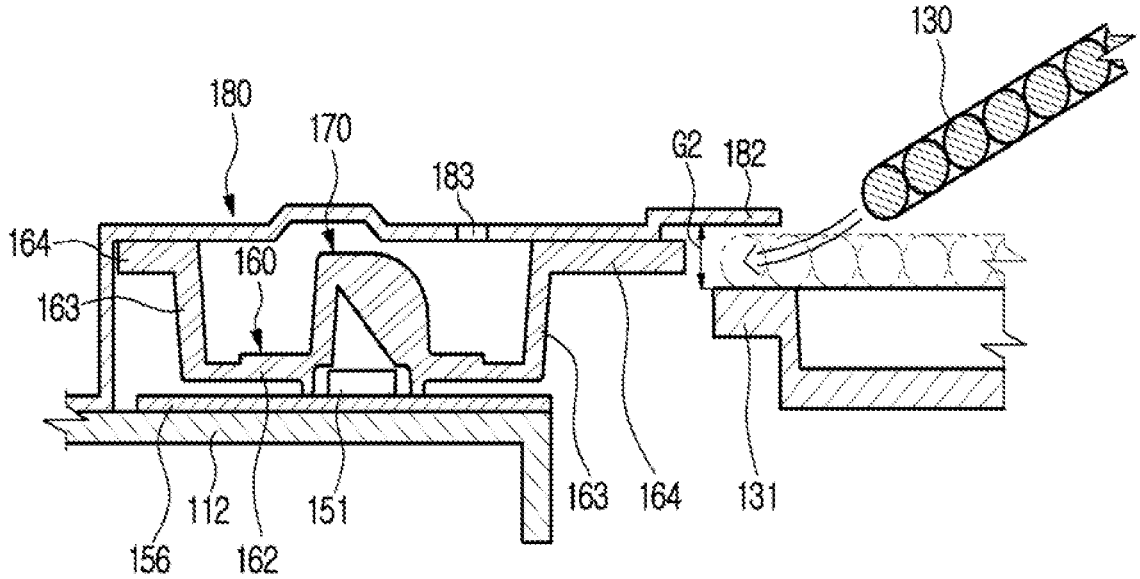

[Fig. 26]
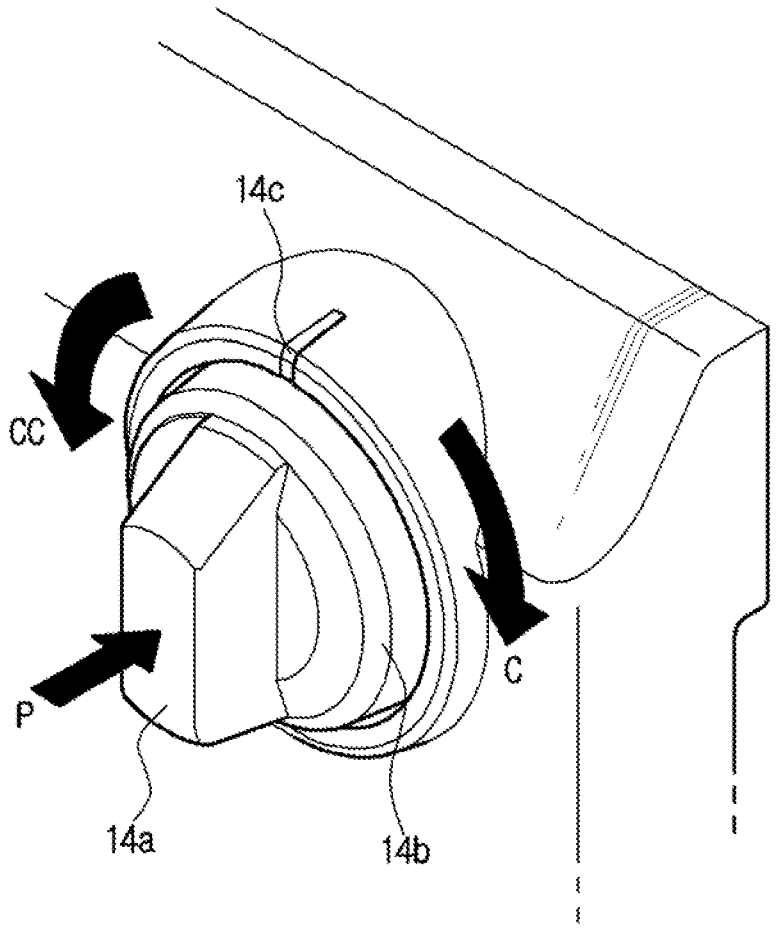

[Fig. 27]
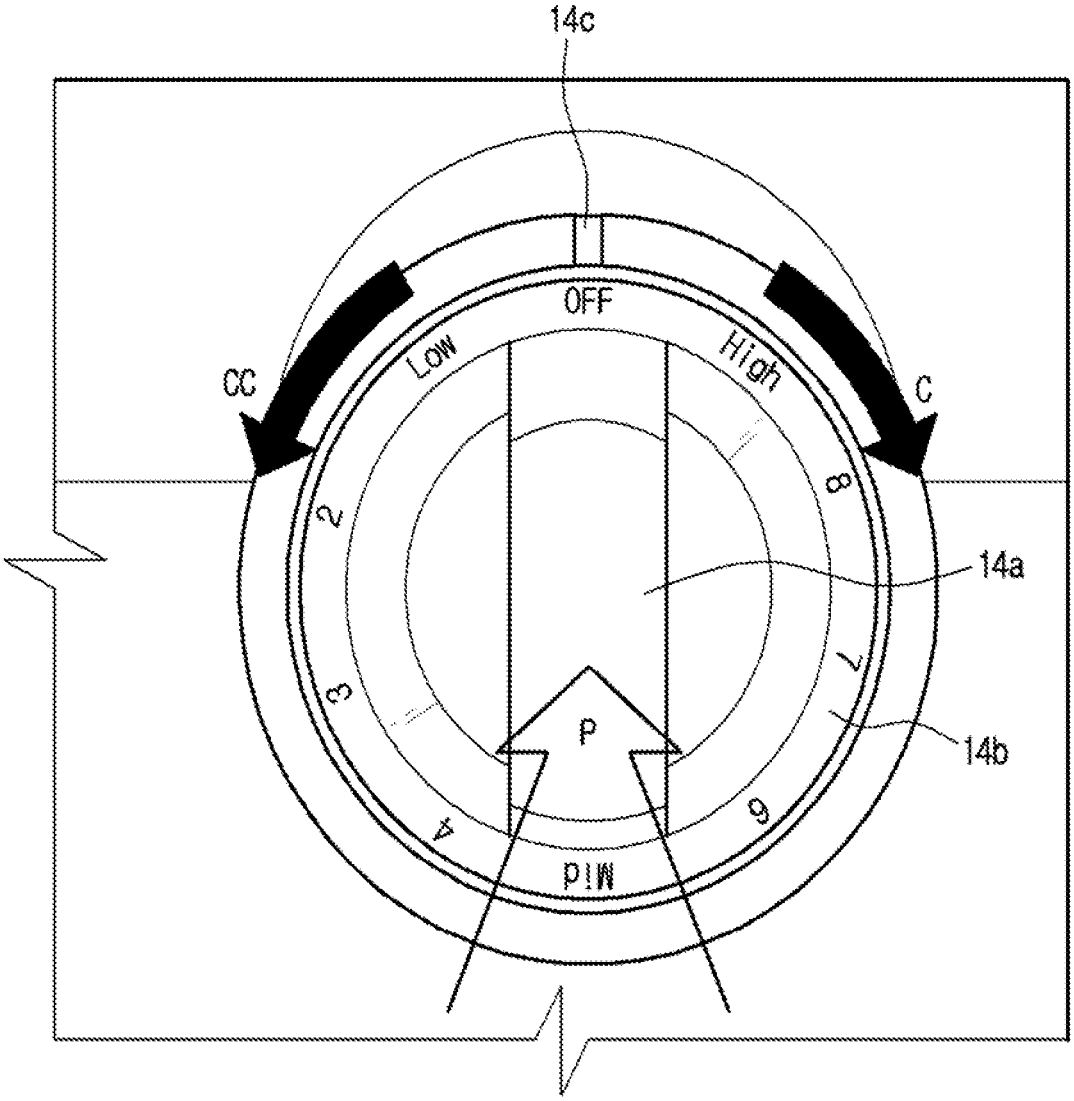

INDUCTION HEATING COOKING DEVICE

CROSS-REFERENCE TO RELATED APPLICATIONS

This application is a divisional application of U.S. patent application Ser. No. 15/315,204, filed on Nov. 30, 2016, which is a U.S. national stage application under 35 U.S.C. 371 of PCT international application PCT/KR2015/004987, filed on May 19, 2015 and claims the benefit of Korean Patent Application No. 10-2014-0066319, filed on May 30, 2014, respectively, the contents are incorporated herein by reference.

BACKGROUND

1. Field

The present invention relates to an induction heating cooking device in which a virtual flame image is displayed on a cooking container to easily recognize a heating state of the cooking container.

2. Description of the Related Art

An induction heating cooking device is a cooking device for heating and cooking food using a principle of induction heating. The induction heating cooking device is provided with a cooking counter on which a cooking container is put and an induction coil for generating a magnetic field when a current is applied.

When the magnetic field is generated by applying the current, a secondary current is induced to the cooking container, and Joule heat is generated due to a resistance component of the cooking container itself. Accordingly, the cooking container is heated and the food put in the cooking container is cooked.

The induction heating cooking device has some advantages that the cooking container can be more rapidly heated than a case with a gas range or a kerosene cooking stove in which a fossil fuel such as gas or oil is burned and the cooking container is heated using combustion heat and a harmful gas is not generated and there is not a fire risk.

However, since the induction heating cooking device does not generate a flame during heating of the cooking container, it is difficult to intuitively recognize a heating state of the cooking container from an outside.

Thus, a level meter type digital display may be provided at the induction heating cooking device to display the heating state of the cooking container. However, since such a digital display has low recognizability, it is difficult for a user to recognize the digital display when the user is away in a certain distance or more from the induction heating cooking device or when the user does not observe the digital display in detail, and it is difficult to be instantly recognized by the user even when the user recognizes the digital display.

SUMMARY

The present invention is directed to providing an induction heating cooking device in which a virtual flame image is displayed on a cooking container.

Also, the present invention is directed to providing an induction heating cooking device in which quality of a flame image and reliability of a product are enhanced by minimizing a distance tolerance between a light source and a main slit.

In accordance with one aspect of the present invention, an induction heating cooking device may include a cooking counter having a cooking panel of which at least a part is formed of a transparent material and a light-shielding layer provided at a lower surface of the cooking panel to have an auxiliary slit; an induction coil for generating a magnetic field to inductively heat a cooking container put on the cooking counter; a light source module having a plurality of light sources disposed outside the induction coil and a printed circuit board on which the plurality of light sources are mounted; and a light source cover having a main slit for passing light emitted from the light source module to form a flame image on the cooking container.

The light source cover may be integrally coupled to the light source module.

The light source cover may be coupled to the light source module by a fastening member.

The printed circuit board may be horizontally disposed about the cooking counter.

The light sources may be mounted on an upper surface of the printed circuit board to emit upward the light.

The light source may include an LED.

The cooking device may include a main board for supporting the induction coil, and a substrate supporter provided separately from the main board, coupled to the main board and configured to support the light source module.

The substrate supporter may include a flat portion formed to be flat and to horizontally support the printed circuit board of the light source module.

The substrate supporter may include a coupling portion configured to protrude from the flat portion to an outside to be coupled to the main board.

The light source cover may include a reinforcing bridge formed to cross the main slit, thereby constantly maintaining a thickness of the main slit and preventing deformation of the thickness of the main slit.

The light source cover may include a first cover portion formed outside the main slit and a second cover portion formed inside the main slit.

The reinforcing bridge may connect the first cover portion with the second cover portion.

The main slit may be continuously formed in a circumferential direction.

The auxiliary slit may be formed at an upper inside of the main slit.

A thickness of the auxiliary slit may be greater than that of the main slit.

The light-shielding layer may be printed on a lower surface of the cooking panel.

The light-shielding layer may be formed in a sheet shape and attached to a lower surface of the cooking panel by an adhesive member.

The cooking device may further include an optical member for changing a travelling direction of the light emitted from the light source module and concentrating the light.

The optical member may be integrally coupled to the light source module and the light source cover.

The cooking counter may include a screen fence provided on an upper surface of the cooking panel to minimize the light emitted from the light source module through the auxiliary slit from being directly exposed to a user's visual field.

In accordance with another aspect of the present invention an induction heating cooking device may include a light source configured to emit light; a light source cover having a main slit for passing the light emitted from the light source; a cooking counter having an auxiliary slit through which the light passed through the main slit passes; an induction coil for generating a magnetic field; and an induction coil supporter for supporting the induction coil.

The cooking counter may include a cooking panel of which at least a part is formed of a transparent material and a light-shielding layer having the auxiliary slit and provided at a lower surface of the cooking panel.

The cooking counter may further include a screen fence provided on an upper surface of the cooking panel to minimize the light source from being directly exposed to a user's visual field through the auxiliary slit.

The screen fence may be provided to extend outward from a vertical upper side of the auxiliary slit.

The light source cover may include a first cover portion formed outward from the main slit and a second cover portion formed inward from the main slit.

The second cover portion may extend inward further than the auxiliary slit to prevent a component under the cooking counter from being exposed to an outside through the auxiliary slit.

A vertical gap may be formed between the second cover portion and the induction coil supporter.

At least a part of the induction coil may be accommodated in the gap.

In the induction heating cooking device according to the spirit of the present invention, since the flame image is formed on the surface of the lower end of the cooking container, the user can intuitively and easily recognize the heating state of the cooking container.

According to the spirit of the present invention, the virtual flame image formed on the cooking container can have a height, a width, a three-dimensional effect and a shade similar to those of an actual flame.

According to the spirit of the present invention, the distance tolerance between the light source and the main slit can be minimized and thus the quality of the flame image and the reliability of a product can enhanced.

According to the spirit of the present invention, the W LEDs or the RGB LEDs can be used as the light sources, and the plurality of light sources can be individually controlled and can create various flames.

According to the spirit of the present invention, since the light emitted from the light sources can be minimized from being exposed to the user by a screen, the flame does not have an artificial feeling and an esthetic sense of the product can be enhanced.

According to the spirit of the present invention, since the cover portion of the light source cover extends in a direction close to the induction coil rather than the auxiliary slit, the inside of the induction heating cooking device can be prevented from being exposed through the auxiliary slit.

BRIEF DESCRIPTION OF THE DRAWINGS

FIG. 1 is a view illustrating an exterior of an oven range having an induction heating cooking device according to a first embodiment of the present invention.

FIG. 2 is an exploded view illustrating a main configuration of the induction heating cooking device of FIG. 1.

FIG. 3 is a plan view illustrating the induction heating cooking device of FIG. 1 except a cooking counter.

FIG. 4 is an exploded view of the cooking counter of the induction heating cooking device of FIG. 1.

FIG. 5 is an exploded view illustrating the light source unit of the induction heating cooking device of FIG. 1.

FIG. 6 is a view illustrating a coupling structure between the substrate supporter and the main board of the induction heating cooking device of FIG. 1.

FIG. 7 is a view illustrating a coupling structure between the printed circuit board and the substrate supporter of the induction heating cooking device of FIG. 1.

FIG. 8 is a view illustrating a coupling structure among the light source cover, the optical member and the light source module of the induction heating cooking device of FIG. 1.

FIG. 9 is a plan view illustrating the light source cover of the induction heating cooking device of FIG. 1.

FIG. 10 is a perspective view illustrating the convex lens of the induction heating cooking device of FIG. 1.

FIG. 11 is a cross-sectional view illustrating the convex lens of the induction heating cooking device of FIG. 1.

FIG. 12 is a view illustrating a length of an incident surface of the convex lens when the LED of the induction heating cooking device of FIG. 1 has three RGB chips.

FIG. 13 is an enlarged view of an A portion of FIG. 12 illustrating a corrosive pattern formed on an incident surface of a lens to mix red light, green light and blue light when the LED of the induction heating cooking device of FIG. 1 has the three chips of RGB.

FIG. 14 is a view illustrating the length of the incident surface of the convex lens when the LED of the induction heating cooking device of FIG. 1 has one WHITE chip.

FIG. 15 illustrates another embodiment of the convex lens of the induction heating cooking device of FIG. 1.

FIG. 16 is a schematic view illustrating a structure in which a flame of the induction heating cooking device of FIG. 1 is formed.

FIG. 17 is a cross-sectional view illustrating a structure in which the flame of the induction heating cooking device of FIG. 1 is formed.

FIG. 18 is a view illustrating the screen fence of the induction heating cooking device of FIG. 1.

FIG. 19 is a view illustrating an action of a horizontal hairline of the surface of the cooking container put on the induction heating cooking device of FIG. 1.

FIG. 20 is a view illustrating a state in which the virtual flame image is formed on the surface of the cooking container put on the induction heating cooking device of FIG. 1.

FIG. 21 is a view schematically illustrating a main configuration of an induction heating cooking device according to a second embodiment of the present invention.

FIG. 22 is a view schematically illustrating a main configuration of an induction heating cooking device according to a third embodiment of the present invention.

FIG. 23 is a view schematically illustrating a main configuration of an induction heating cooking device according to a fourth embodiment of the present invention.

FIG. 24 is a view illustrating an action of the light source cover for preventing a component under the cooking counter of the induction heating cooking device of FIG. 1 from being exposed.

FIG. 25 is a view illustrating an assembling process of the induction coil of the induction heating cooking device of FIG. 1.

FIGS. 26 and 27 are enlarged views illustrating an operation unit of the induction heating cooking device of FIG. 1.

DETAILED DESCRIPTION

Hereinafter, exemplary embodiments of the present invention will be described in detail.

FIG. 1 is a view illustrating an exterior of an oven range having an induction heating cooking device according to a first embodiment of the present invention. FIG. 2 is an exploded view illustrating a main configuration of the induction heating cooking device of FIG. 1. FIG. 3 is a plan view illustrating the induction heating cooking device of FIG. 1 except a cooking counter.

Referring to FIGS. 1 to 3, an oven range 1 may integrally include an oven 10 provided at a lower portion thereof and an induction heating cooking device 100 provided at an upper portion thereof. The induction heating cooking device 100 according to an embodiment of the present invention may be integrally formed with the oven 10 or may be separately provided from the oven 10.

The oven 10 may generate high-temperature heat using gas or electricity and may cook food inside a cavity by convection of air. Doors 11 and 12 of the oven 10 may be provided at a front surface of the oven range 1. Each of the doors 11 and 12 of the oven 10 may be rotated about a hinge shaft to be opened and closed. A display unit 13 for displaying an operating state of the oven range 1 and an operation unit 14 for operating various functions of the oven range 1 may be provided above the doors 11 and 12 of the oven 10.

The induction heating cooking device 100 may include a main body 110, a cooking counter 120 on which a cooking container is put, an induction coil 130 for generating a magnetic field to inductively heat the cooking container, a light source unit 140 for emitting light, a power supply unit for supplying an electric power to the induction coil 130 and the light source unit 140 or cutting off the power supply, a light source controller 115 for controlling turning-on, turning-off and brightness of the light source unit 140, a cooling unit 116 for cooling various electronic components and the light source unit 140, and an auxiliary display unit 119 for displaying operation information of the induction heating cooking device 100.

The main body 110 is formed in an approximately box shape of which an upper surface is opened, and the cooking counter 120 may be coupled to the opened upper surface of the main body 110. A main board 111 is provided inside the main body 110, and the induction coil 130 may be supported by the main board 111. A machinery chamber 114 may be formed under the main board 111.

The cooking counter 120 may have a flat shape to horizontally support the cooking container.

The induction coil 130 is horizontally arranged under the cooking counter 120. The induction coil 130 may be installed on an induction coil supporter 131 (FIG. 17) installed at the main board 111. In the embodiment, four induction coils 130 including one large-sized induction coil, two middle-sized induction coils and one small-sized induction coil may be provided, but the number of induction coils 130 is not limited.

In the embodiment, the induction coil 130 is formed in an approximately circular shape. However, the induction coil 130 is not limited thereto and may be formed in a quadrangular shape or various other shapes.

When a current is applied to the induction coil 130, the induction coil 130 may vertically form a magnetic field. Due to the magnetic field, a secondary current is induced to the cooking container put on the cooking counter 120, and Joule heat may be generated by a resistance component of the cooking container itself. Accordingly, the cooking container is heated, and thus the food put in the cooking container may be cooked. The cooking container should have an iron content or a magnetic property.

The number of light source units 140 may be provided to correspond to the number of induction coils 130. The light source unit 140 may be installed on a substrate supporter 112. The substrate supporter 112 will be described later. The light source unit 140 may be provided at a radial outside of the induction coil 130 in a circumferential direction thereof.

In the embodiment with regard to the induction coil formed in an approximately circular shape, the light source units 140 may be provided in an angular range of about 120 degrees at a front of the induction heating cooking device but are not limited thereto. For example, the light source units 140 may be provided in a range of about 180 or 360 degrees. However, since the induction heating cooking device is generally disposed at a wall surface of a kitchen and a user usually sees only a front surface of the induction heating cooking device, it is not necessary to dispose the light source units 140 at a rear surface and a side surface of the induction heating cooking device and an effect of the present invention may be achieved by just providing the light source units 140 in the range of about 120 degrees.

The light source units 140 may form a flame image on a surface of a lower end of the cooking container to intuitively recognize a heating state of the cooking container when the current is applied to the induction coil 130 and the cooking container is heated (FIG. 20). At this point, the cooking container may serve as a screen on which the light is projected.

The light source units 140 may include a light source module 150 (FIG. 5) having a light source 151 (FIG. 5) and a printed circuit board 156 (FIG. 5), an optical member 160 (FIG. 5) for guiding light emitted from the light source module 150 toward the lower end of the cooking container and concentrating the light, and a light source cover 180 (FIG. 5) having a main slit 183 (FIG. 5) through which the light emitted from the optical member 150 passes so as to form the flame image on the lower end of the cooking container. A detailed configuration of the light source unit 140 will be described later.

The light source controller 115 may control the turning-on, the turning-off and the brightness of the light source. The light source controller 115 may control an amount of the current applied to the light source and may adjust a size and a brightness of the virtual flame image.

Also, when a plurality of light sources are included in the light source module 140, the light source controller 115 may control all of the plurality of light sources at the same time, may individually control each of the plurality of light sources, or may divide the plurality of light sources into sections and may divisionally or sequentially control the sections. Therefore, the flame image may be variously created. For example, the flame may be sequentially turned on or off in one direction when a heating operation starts or is terminated, or some or all of the flames may be flashed on and off at short intervals to attract the user's attention.

The cooling unit 116 may include a fan 117 for forcibly flowing air, a heat sink 118, and a duct (not shown) for guiding a flow of the air. The cooling unit 116 may release heat generated from the induction coil 130 and the light source unit 140 by circulating the air in the machinery chamber 114.

The auxiliary display unit 119 may indicate whether the induction heating cooking device is operated using a level meter or may indicate a heating temperature or an operation time of the induction heating cooking device using a 7-digit segment.

FIG. 4 is an exploded view of the cooking counter of the induction heating cooking device of FIG. 1. The cooking counter of the induction heating cooking device according to the first embodiment of the present invention will be described with reference to FIG. 4.

The cooking counter 120 supports the cooking container. The cooking counter 120 includes a cooking panel 121 formed of a transparent material and a light-shielding layer 123 provided at a lower surface of the cooking panel 121 and having an auxiliary slit 124.

The cooking panel 121 has a flat plate shape and should also have a sufficient strength to support the cooking container and a heat-resisting property to endure heat. To this end, the cooking panel 121 may be formed of a reinforced heat-resistant glass or a reinforced ceramic material.

The cooking panel 121 is formed of a transparent material so that the light emitted from the light source unit 140 passes therethrough and then is projected to the cooking container. However, since it is sufficient for the cooking panel 121 to pass only a part of a beam of light emitted from the light source unit 140 which forms the flame image, the entire cooking panel 121 does not need to be transparent, and only a part thereof may be formed to be transparent.

That is, an entire area of the cooking panel 121 does not need to be formed in a transparent material, and only a part thereof through which the beam of light directed toward the cooking container passes may be formed of the transparent material, and the remaining area may be formed of an opaque material, and thus a manufacturing cost of the cooking panel 121 may be reduced.

The light-shielding layer 123 prevents various components provided under the cooking panel 121 from being exposed to an outside. Therefore, the light-shielding layer 123 may have a black color having a low light transmittance.

The auxiliary slit 124 is formed at the light-shielding layer 123 not to block the beam of light directed toward the cooking container. The auxiliary slit 124 allows the light emitted from the light source unit 140 and passed through the main slit 183 (FIG. 17) of the light source cover 180 (FIG. 17) not to be blocked by the light-shielding layer 123 but to be projected to the cooking container. The auxiliary slit 124 may be formed at a radial inside of an upper (above) side of the main slit 183.

It is preferable that the auxiliary slit 124 does not have an influence on a size of the flame image. This is because the auxiliary slit 124 is more distant from the light source 151 (FIG. 17) than the main slit 183 and thus a distance tolerance between the light source 151 and the auxiliary slit 124 may be increased.

Therefore, a thickness D2 (FIG. 17) of the auxiliary slit 124 may be formed thicker than that D1 (FIG. 17) of the main slit 183 so that the light passed through the main slit 183 is not blocked but passes therethrough.

The auxiliary slit 124 is formed in an arc shape and may be formed in a range of about 120 degrees in a circumferential direction. However, the auxiliary slit 124 is not limited thereto and may be formed in various angular ranges such as 180 and 360 degrees.

The auxiliary slit 124 may be continuously formed in the circumferential direction. However, the auxiliary slit 124 is not limited thereto and may be discontinuously formed to correspond to the number of a plurality of beams of light.

The light-shielding layer 123 may include an UI hole 125 through which the light emitted from the auxiliary display unit 119 (FIG. 2) passes.

The light-shielding layer 123 may be provided in a separate sheet shape and then may be attached to the lower surface of the cooking panel 121 by an adhesive member.

Alternatively, the light-shielding layer 123 may be printed on the lower surface of the cooking panel 121. A glassware printing may be used as a printing method thereof. The glassware printing is a printing method in which a pattern is applied to glass and an ink is coated thereon and then heated at a high temperature as if baking pottery and thus the ink is impregnated in the glass.

The cooking counter 120 may include a screen fence 127 provided on an upper surface of the cooking panel 121 to minimize the light of the light source unit 140 from being directly exposed to the user, thereby concealing the light source 151. The screen fence 127 may have a block color having a low light transmittance.

The screen fence 127 is formed in an arc shape and may be formed in a range of about 120 degrees in the circumferential direction. However, the screen fence 127 is not limited thereto and may be formed in various angular ranges such as 180 and 360 degrees.

The screen fence 127 may be provided to extend from a vertical upper side of the auxiliary slit 124 toward a radial outside thereof. As described above, when the screen fence 127 is disposed from the vertical upper side of the auxiliary slit 124 toward the radial outside thereof, the beam of light directed to be inclined upward from the light source unit 140 toward the cooking container may not be blocked and the light passed through the auxiliary slit 124 may also be minimized from being directly exposed to a user's visual field (referring to FIG. 18).

Since the light source 151 is minimized by the screen fence 127 from being directly exposed to the user, the user may not recognize existence of the light source 151, and thus a feeling that the flame image is artificially formed may not be provided, and an esthetic sense of the product may be enhanced.

The screen fence 127 may be provided in a separate sheet shape and then may be attached to the upper surface of the cooking panel 121 by an adhesive member. Alternatively, the screen fence 127 may be printed on the upper surface of the cooking panel 121. The glassware printing may be used as a printing method thereof.

The cooking counter 120 may include a container guide line 122 for guiding an appropriate position of the cooking container. The container guide line 122 may have an approximate size corresponding to a size of the induction coil 130. The container guide line 122 may be formed by a printing or an attaching.

FIG. 5 is an exploded view illustrating the light source unit of the induction heating cooking device of FIG. 1. FIG. 6 is a view illustrating a coupling structure between the substrate supporter and the main board of the induction heating cooking device of FIG. 1. FIG. 7 is a view illustrating a coupling structure between the printed circuit board and the substrate supporter of the induction heating cooking device of FIG. 1. FIG. 8 is a view illustrating a coupling structure among the light source cover, the optical member and the light source module of the induction heating cooking device of FIG. 1. FIG. 9 is a plan view illustrating the light source cover of the induction heating cooking device of FIG. 1.

A configuration of the light source unit 140 of the induction heating cooking device 100 according to the first embodiment of the present invention will be described with reference to FIGS. 5 to 9.

The light source unit 140 may include the light source module 150 for emitting a plurality of beams of light, the optical member 160 for refracting or reflecting the light emitted from the light source module 150 and changing a travelling direction of the light and also concentrating the light, and the light source cover 180 having the main slit 183 for passing the light of which the travelling direction is changed and which is concentrated by the optical member 160 and thus forming the flame image on the surface of the cooking container.

The light source module 150 includes the light source 151 for emitting the light, and the printed circuit board 156 on which the light source 151 is mounted and supplying the electric power to the light source 151.

In the embodiment, an LED (light emitting diode) is used as the light source 151. The LED 151 has advantages of a small size, excellent light-emitting efficiency and a long life span. However, the light source 151 does not always include only the LED 151 and may include various light-emitting means such as a cold cathode fluorescent lamp, an external electrode fluorescent lamp and a carbon nano-tube lamp.

The light source module 150 may have the number of LEDs 151 corresponding to the number of flame images intended to be formed on the cooking container. That is, one LED 151 may form one flame image. The LEDs 151 may be arranged to be spaced apart from each other at predetermined intervals in a circumferential direction of the induction coil 130. The LEDs 151 may be arranged in front of the induction heating cooking device 100 within an angular range of about 120 degrees. However, the LEDs 151 are not limited thereto and may be arranged in a range of 180 or 360 degrees.

The LED 151 may be a white LED (FIG. 14) having one chip or an RGB LED (FIGS. 11 and 12) having three chips. When the RGB LEDs having a red color, a green color and a blue color are used, a color further similar to an actual flame may be realized by combining each of the colors.

In the embodiment, the LED 151 is an SMD (surface mount device) type LED used in a mounted state on the printed circuit board 156, and a COB (chip on board) type LED in which an LED chip itself is mounted and molded on the printed circuit board 156 may also be used.

The LED 151 may be mounted on an upper surface of the printed circuit board 156 so that a light-emitting surface thereof is directed upward. That is, the LED 151 may emit upward light at a predetermined pointing angle. For example, in the embodiment, the pointing angle of the LED 151 may be about 120 degrees.

The printed circuit board 156 on which the LED 151 is mounted is provided to be horizontal with respect to the cooking counter 120. In particular, the printed circuit board 156 may be mounted on the separate substrate supporter 112 rather than the main board 111 so that flatness thereof may be generally uniformly maintained.

The substrate supporter 112 is molded separately from the main board 111 and then coupled to the main board 111. Since the main board 111 has a large size, it is difficult to generally uniformly maintain the flatness. However, the substrate supporter 112 has a small size corresponding to a size of the printed circuit board 156 and thus the flatness thereof may be generally uniformly maintained.

As illustrated well in FIG. 6, the substrate supporter 112 may have a flat portion 112*a* on which the printed circuit board 156 is mounted and supported and a coupling portion 112*b* coupled to the main board 111. The flat portion 112*a* may be formed to be flat without being curved, such that all of a plurality of LEDs 151 mounted on the printed circuit board 156 emit the light in the same direction.

A plurality of coupling portions 112*b* may be formed to protrude outside the flat portion 112*a* and may be firmly coupled to the main board 111 by a fastening member S1 such as a screw.

As illustrated well in FIG. 7, the printed circuit board 156 on which the LEDs 151 are mounted may be installed on an upper surface of the flat portion 112*a* of the substrate supporter 112. The printed circuit board 156 may be firmly coupled to the substrate supporter 112 by a fastening member S2.

Accordingly, the plurality of LEDs 151 mounted on the printed circuit board 156 may be formed so that a direction of the light emitted from each of them becomes the same as each other. Therefore, the sizes and the brightnesses of the flame image formed on the cooking container may have unity, and reliability of a product may be enhanced.

The optical member 160 refracts or reflects the light emitted from the LED 151, changes the travelling direction thereof and concentrates the light. Since the light is concentrated by the optical member 160, a going-straight property of the light can be enhanced, and the brightness of the flame image may also be increased.

The optical member 160 of the induction heating cooking device according to the first embodiment of the present invention includes a convex lens 170 for refracting and concentrating the light and a base portion 161 for supporting the convex lens 170. The convex lens 170 and the base portion 161 of the optical member 160 may be integrally formed. The convex lens 170 and the base portion 161 of the optical member 160 may be integrally injection-molded with a resin material such as silicone. Alternatively, the convex lens 170 and the base portion 161 may be formed of a glass material.

The number of convex lenses 170 is provided to correspond to the number of LEDs 151 and also provided to be spaced apart from each other in a circumferential direction, thereby corresponding to the LEDs 151.

The convex lens 170 changes the travelling direction of the light emitted vertically upward from the LED 151 to be inclined upward toward the main slit 183 and the cooking container. A detailed configuration of the convex lens 170 will be described later.

The base portion 161 may include a bottom portion 162 (FIG. 17) horizontally formed at a lower portion thereof, a vertical portion 163 (FIG. 17) extending from the bottom portion 162 in a predetermined height, and a flange portion 164 (FIG. 17) horizontally extending from the vertical portion 163 to be in close contact with and coupled to the light source cover 180. The convex lens 170 may be formed at the bottom portion 162. The bottom portion 162 may include a close-contacting protrusion 162*a* (FIG. 11) protruding downward to be in close contact with the printed circuit board 156. The vertical portion 163 may block the heat generated from the induction coil 130 from being transferred to the convex lens 170 and the light source 151. The optical member 160 may be fixed to the printed circuit board 156 and the substrate supporter 112 by a fastening member S3 such as a screw.

The light source cover 180 may cover the convex lens 170 and may prevent foreign substances from being introduced to the convex lens 170.

The light source cover 180 includes a first cover portion 181 provided at a radial outside thereof, a second cover portion 182 provided at a radial inside thereof, and the main slit 183 formed between the first cover portion 181 and the second cover portion 182. The first cover portion 181 and the second cover portion 182 may be in close contact with the flange portion 164 of the optical member 160.

The main slit 183 of the light source cover 180 serves to pass the light emitted from the LED 151 and thus to form the flame image on the cooking container. The light source cover 180 passes, through the main slit 183, a part of the beams of light emitted from the LED 181 which is directed toward the cooking container and blocks the remaining beams of light.

The main slit 183 is located at a radial inside of a vertical upper side of the LED 151. Therefore, the light emitted from the LED 151 travels to be inclined upward toward the main slit 183.

The main slit 183 may be formed within a predetermined angular range in the circumferential direction. In the embodiment, the main slit 183 has been formed in the range of 120 degrees in the circumferential direction. However, the main slit 183 is not limited thereto and may also be formed in a range of 180 or 360 degrees.

The main slit 183 may be continuously formed with a predetermined thickness D1 (FIG. 17) in the circumferential direction. Therefore, the main slit D1 may influence only a height of the flame image and may not influence a width of the flame image. That is, the height of the flame image is determined by the thickness of the main slit D1, but the width of the flame image may be determined by shapes of the LED 151 and the convex lens 170.

The light source cover 180 may have at least one reinforcing bridge 184 (FIG. 9) formed at the main slit 183 to constantly maintain the thickness D1 of the main slit 183 and also to prevent a deformation of the main slit 183 due to an external force.

The reinforcing bridge 184 is provided to connect the first cover portion 181 with the second cover portion 182 and thus to cross the main slit 183. One or more reinforcing bridges 184 may be formed at positions which do not interfere with the beams of light not to influence the flame image.

The light source cover 180 may be coupled to the optical member 160 by a coupling protrusion structure or a fastening member. The coupling protrusion structure may include a coupling hole 185 formed at the light source cover 180 and a coupling protrusion 164*a* formed at the optical member 160. Also, the light source cover 180 may be coupled to the substrate supporter 112 by a fastening member S4.

As a result, due to such a configuration, the light source module 150, the optical member 160 and the light source cover 180 may be integrally coupled to the substrate supporter 112. Therefore, a distance tolerance between the LED 151 of the light source module 150 and the main slit 183 of the light source cover 180 may be minimized.

A distance between the LED 151 of the light source module 150 and the main slit 183 of the light source cover 180 is a factor having the greatest influence on the size and the brightness of the flame image formed on the cooking container. As described above, in the induction heating cooking device according to the first embodiment of the present invention, the printed circuit board 156 of the light source module 150 is installed at the substrate supporter 112 provided separately from the main board 111 to have high flatness, and the light source module 150, the optical member 160 and the light source cover 180 are integrally coupled, and thus the distance tolerance between the LED 151 of the light source module 150 and the main slit 183 of the light source cover 180 is minimized. Therefore, the quality of the flame image and the reliability of the product may be enhanced.

FIG. 10 is a perspective view illustrating the convex lens of the induction heating cooking device of FIG. 1. FIG. 11 is a cross-sectional view illustrating the convex lens of the induction heating cooking device of FIG. 1. FIG. 12 is a view illustrating a length of an incident surface of the convex lens when the LED of the induction heating cooking device of FIG. 1 has three RGB chips. FIG. 13 is an enlarged view of an A portion of FIG. 12 illustrating a corrosive pattern formed on an incident surface of a lens to mix red light, green light and blue light when the LED of the induction heating cooking device of FIG. 1 has the three chips of RGB. FIG. 14 is a view illustrating the length of the incident surface of the convex lens when the LED of the induction heating cooking device of FIG. 1 has one WHITE chip. FIG. 15 illustrates another embodiment of the convex lens of the induction heating cooking device of FIG. 1.

A structure of the convex lens of the induction heating cooking device according to the first embodiment of the present invention will be described with reference to FIGS. 10 to 15.

The convex lens 170 refracts the light emitted vertically upward from the LED 151, changes the travelling direction thereof to be inclined toward the main slit 183 and concentrates the light.

The convex lens 170 may include a hemispherical portion 171 having a hemispherical exterior and a protruding portion 172 protruding to an outside further than the hemispherical portion 171. The hemispherical portion 171 is located in a direction directed toward the main slit 183, and the protruding portion 172 is located in an opposite direction thereto. In the embodiment, the protruding portion 172 has an approximately hexahedral shape, but a shape of the protruding portion 172 is not limited.

However, the protruding portion 172 is not essential. As illustrated in FIG. 15, a convex lens 170*c* may include only a hemispherical portion 171*c* without the protruding portion. The reason thereof will be described later.

The convex lens 170 has an empty space 173 formed therein. Also, the convex lens 170 may have an accommodation space 174 for accommodating the LED 151. The empty space 173 may have an approximately triangular shape when being seen from a side, and the accommodation space 174 may have an approximately quadrangular shape. The light emitted from the ELD 151 may travel toward an incident surface 175 of the convex lens 170 in the triangular empty space 173.

The protruding portion 172 is to assist a molding of the convex lens 170 and serves to widen a gap G1 between a portion around a triangular vertex 173*a* of the empty space 173 and an outer surface 172*a* of the protruding portion 172 adjacent thereto so that the portion around the triangular vertex 173*a* is evenly filled with a resin upon an injection molding of the convex lens 170. As the gap is widened as described above, the resin may be sufficiently evenly filled during the filling of the resin.

The convex lens 170 may have a first incident surface 175 and a second incident surface 176. The first incident surface 175 refracts the light emitted from the LED 151 toward the main slit 183.

The first incident surface 175 is formed in a flat surface and formed to be inclined at a predetermined angle with respect to the cooking counter 120. Since the first incident surface 175 serves to substantially change the travelling direction of the light emitted vertically upward from the LED 151 toward the main slit 183, the flatness and the angle thereof should be precisely designed. However, since most of the light passed through the second incident surface 176 is blocked by the light source cover 180, a shape and an angle of the second incident surface 176 may be freely designed.

The convex lens 170 has an exit surface 177 to which the light refracted through the first incident surface 175 is projected. The exit surface 177 is provided to be directed toward the main slit 183. The exit surface 177 may be a spherical surface or a curved surface having a predetermined curvature. The exit surface 177 is formed to be convex outward and concentrates the light. For example, assuming that a pointing angle of the light emitted from the LED 151 is about 120 degrees, the pointing angle of the light passed through the convex lens 170 may be reduced to about 45 to 65 degrees.

As described above, since the light is concentrated, the going-straight property of the light may be enhanced, and an intensity of the light may be increased even when an output of the LED 151 is not increased. Also, due to a refraction effect of the light, a shape of the flame image formed on the cooking container may have a three-dimensional effect and thus may be further similar to the actual flame.

A length L1 (FIG. 12) of the incident surface 175 of the convex lens 170 and a size of the empty space 173 may be determined by the number, positions and the pointing angles of chips 152, 153 and 154 of the LED 151.

For example, as illustrated in FIG. 12, when the LED 151 has the three RGB chips 152, 153 and 154, the length L1 of the incident surface 175 should have a sufficient length to cover all of the light emitted from the chip 154 located closest to the incident surface 175 and the light emitted from the chip 152 located farthest away therefrom.

However, as illustrated in FIG. 14, when the LED 151 has one chip 155, it is sufficient for a length L2 of an incident surface 175*b* of a convex lens 170*b* to cover only the light emitted from the one chip 155. That is, the length L2 of the incident surface 175*b* of the convex lens 170*b* and a size of an empty space 173*b* when the LED 151 has the one chip 155 are smaller than the length L1 of the incident surface 175 of the convex lens 170 and the size of the empty space 173 when the LED 151 has the three chips 152, 153 and 154.

Meanwhile, since positions of the chips 152, 153 and 154 are different from each other when the LED 151 has the three RGB chips 152, 153 and 154, a color of the flame image may be changed according to the positions of the chips 152, 153 and 154. In order to prevent this problem, the incident surface 175 of the convex lens 170 according to the embodiment of the present invention may have a corrosive pattern 178 (FIG. 13) for mixing the light emitted from each of the RGB chips 152, 153 and 154 with each other and emitting light having one color. In the embodiment, the corrosive pattern 170 has been formed at the incident surface 175 but may be formed at the exit surface 177.

As illustrated in FIG. 13, the corrosive pattern 178 may have a concavo-convex portion for variously changing a refraction angle of the light. The corrosive pattern 178 may be molded together when the convex lens 170 is molded. That is, the corrosive pattern 178 may be completed by forming the corrosive pattern 178 at a mold for molding the convex lens 170 when a filling of the resin is finished.

FIG. 16 is a schematic view illustrating a structure in which a flame of the induction heating cooking device of FIG. 1 is formed. FIG. 17 is a cross-sectional view illustrating a structure in which the flame of the induction heating cooking device of FIG. 1 is formed. FIG. 18 is a view illustrating the screen fence of the induction heating cooking device of FIG. 1. FIG. 19 is a view illustrating an action of a horizontal hairline of the surface of the cooking container put on the induction heating cooking device of FIG. 1. FIG. 20 is a view illustrating a state in which the virtual flame image is formed on the surface of the cooking container put on the induction heating cooking device of FIG. 1.

A flame forming action in the induction heating cooking device according to the first embodiment of the present invention will be described with reference to FIGS. 16 to 20.

As described above, the induction heating cooking device 100 may include the cooking panel 121 of which at least a part is formed of the transparent material, the light-shielding layer 123 provided at the lower surface of the cooking panel 121 and having the auxiliary slit 124, the induction coil 130 for generating the magnetic field to inductively heat the cooking container C, the light source module 150 having the printed circuit board 156 on which the plurality of light sources 151 are mounted, the optical member 160 having the convex lens 170 for changing the travelling direction of the light emitted from the light source module 150 and concentrating the light, the light source cover 180 having the main slit 183 for passing the light emitted from the light source module 150 to form the flame image on the cooking container C, and the screen fence 127 provided on the upper surface of the cooking panel 121 to minimize the light of the light source module 150 from being directly exposed to the user and to conceal the light source 151.

When the electric power is applied to the induction coil 130 and the heating of the cooking container C starts, a current is applied to the light source 151 of the light source module 150 and the light is emitted. The travelling direction of the light emitted vertically upward from the light source 151 is changed to be inclined toward the main slit 183 while passing through the convex lens 170 of the optical member 160 and then the light is concentrated. The light passed through the main slit 183 passes through the auxiliary slit 124 and is projected to the surface of the lower end of the cooking container C.

As illustrated in FIG. 19, the light projected to the cooking container C may form the flame image F similar to the actual flame while being scattered and reflected upward and downward by a horizontal hairline H machined on the surface S of the cooking container C.

FIG. 21 is a view schematically illustrating a main configuration of an induction heating cooking device according to a second embodiment of the present invention. FIG. 22 is a view schematically illustrating a main configuration of an induction heating cooking device according to a third embodiment of the present invention. FIG. 23 is a view schematically illustrating a main configuration of an induction heating cooking device according to a fourth embodiment of the present invention.

Induction heating cooking devices according to second to fourth embodiments of the present invention will be described with reference to FIGS. 21 to 23. The same elements as those in the first embodiment will be designated by the same reference numerals, and descriptions thereof will be omitted.

As illustrated in FIG. 21, an induction heating cooking device 200 may include the cooking panel 121 of which at least a part is formed of the transparent material, the light-shielding layer 123 provided at the lower surface of the cooking panel 121 and having the auxiliary slit 124, the induction coil 130 for generating the magnetic field to inductively heat the cooking container C, the light source module 150 having the printed circuit board 156 on which the plurality of light sources 151 are mounted, the optical member 160 having the convex lens 170 for changing the travelling direction of the light emitted from the light source module 150 and concentrating the light, and the light source cover 180 having the main slit 183 for passing the light emitted from the light source module 150 to form the flame image on the cooking container C.

That is, in the induction heating cooking device 200 according to the second embodiment of the present invention, the screen fence 127 provided on the upper surface of the cooking panel 121 to minimize the light emitted from the light source 151 from being directly exposed to the user and thus to conceal the light source 151 is omitted from the elements of the induction heating cooking device 100 according to the first embodiment of the present invention. Since the light of the LED 121 is directly exposed in the form of a thin band to the user through the auxiliary slit 124 due to absence of the screen fence 127, the esthetic sense may be slightly reduced, but formation of the flame image is not interrupted.

As illustrated in FIG. 22, an induction heating cooking device 300 may include the cooking panel 121 of which at least a part is formed of the transparent material, the light-shielding layer 123 provided at the lower surface of the cooking panel 121 and having the auxiliary slit 124, the induction coil 130 for generating the magnetic field to inductively heat the cooking container C, the light source module 150 having the printed circuit board 156 on which the plurality of light sources 151 are mounted, the light source cover 180 having the main slit 183 for passing the light emitted from the light source module 150 to form the flame image on the cooking container C, and the screen fence 127 provided on the upper surface of the cooking panel 121 to minimize the light of the light source module 150 from being directly exposed to the user and to conceal the light source 151.

That is, in the induction heating cooking device 300 according to the third embodiment of the present invention, the optical member 160 having the convex lens 170 for changing the travelling direction of the light emitted from the light source module 150 and concentrating the light is omitted from the elements of the induction heating cooking device 100 according to the first embodiment of the present invention.

In this embodiment, the light emitted from the light source module 150 may directly pass through the main slit 183 of the light source cover 180 and may form the flame image on the cooking container C. However, a light-concentrating degree is reduced due to absence of the optical member 160 having the convex lens 170 and the brightness of the flame image may be weak, but this problem may be compensated by increasing an output of the LED 151.

In addition, as illustrated in FIG. 23, an induction heating cooking device 400 may include the cooking panel 121 of which at least a part is formed of the transparent material, the light-shielding layer 123 provided at the lower surface of the cooking panel 121 and having the auxiliary slit 124, the induction coil 130 for generating the magnetic field to inductively heat the cooking container C, the light source module 150 having the printed circuit board 156 on which the plurality of light sources 151 are mounted, and the light source cover 183 having the main slit 183 for passing the light emitted from the light source module 150 to form the flame image on the cooking container C.

That is, in the induction heating cooking device 400 according to the fourth embodiment of the present invention, all of the optical member 160 and the screen fence 127 are omitted from the elements of the induction heating cooking device 100 according to the first embodiment of the present invention.

FIG. 24 is a view illustrating an action of the light source cover for preventing a component under the cooking counter of the induction heating cooking device of FIG. 1 from being exposed. FIG. 25 is a view illustrating an assembling process of the induction coil of the induction heating cooking device of FIG. 1.

Referring to FIG. 24, the second cover portion 182 of the light source cover 180 may prevent a component such as the optical member 160 located under the cooking counter 120 from being exposed to an outside through the auxiliary slit 124. To this end, an innermost end 182*a* of the second cover portion 182 may extend to a radial inside thereof further than the auxiliary slit 124.

Referring to FIG. 25, the second cover portion 182 of the light source cover 180 may extend to an radial inside thereof further than an outermost end 131*a* of the induction coil supporter 131. A predetermined gap G2 in which the induction coil 130 may be installed is formed vertically between the second cover portion 182 and the induction coil supporter 131. That is, at last a part of an outer edge of the induction coil 130 may be accommodated in the gap G2.

Therefore, after the induction coil supporter 131 is installed at the main board 111 and the light source cover 180 is installed at the substrate supporter 112, the induction coil 130 is obliquely moved to the gap G2 formed between the induction coil supporter 131 and the light source cover 180, and thus the induction coil 130 may be installed on the induction coil supporter 131. Therefore, the second cover portion 182 of the light source cover 180 may serve as a guide portion for guiding an installation of the induction coil 130.

FIGS. 26 and 27 are enlarged views illustrating an operation unit of the induction heating cooking device of FIG. 1.

The operation unit 14 for receiving an output level of the induction heating cooking device 100 may include an operation knob 14*a* provided to be rotatable. The operation knob 14*a* may be rotated in a clockwise direction C or a counterclockwise direction CC.

An output level mark 14*b* may be provided at an edge of the operation knob 14*a* to display the output level. The output level mark 14*b* may be rotated together with the operation knob 14*a*.

An indication mark 14*c* for indicating the output level selected by the operation knob 14*a* may be formed at the main body of the induction heating cooking device 100. The indication mark 14*c* is fixed to the main body of the induction heating cooking device 100. In the embodiment, the indication mark 14*c* has been provided at an approximately upper side of the operation knob 14*a*. However, a position of the indication mark 14*c* is not limited.

The user may slightly press the operation knob 14*a* in a direction P toward the main body of the induction heating cooking device 100 and then may rotate the operation knob 14*a* when operating the induction heating cooking device 100. Due to such an operating method of the operation knob 14*a*, the induction heating cooking device 100 may further have a feeling like a gas range.

When the user rotates the operation knob 14*a* in the clockwise direction C or the counterclockwise direction CC, the output level mark 14*b* is rotated together with the operation knob 14*a*, and one of a plurality of output levels indicated on the output level mark 14*b*, which faces the indication mark 14*c*, may be input to the induction heating cooking device 10.

For example, when the user rotates the operation knob 14*a* in the counterclockwise direction CC, the output level 1, 2, 3, . . . 9 faces the indication mark 14*c* according to rotation of the operation knob 14*a*, as illustrated in FIG. 27, and the output level 1, 2, 3, . . . 9 may be input to the oven range 1.

In addition, when the user rotates the operation knob 14*a* in an OFF state in the clockwise direction C, a maximum output level may be input to the induction heating cooking device 1.

In other words, when the user rotates the operation knob 14*a* in the OFF state in the counterclockwise direction CC, the output level indicated on the output level mark 14*b* is input in turn, and when the user rotates the operation knob 14*a* in the OFF state in the clockwise direction, the maximum output level may be immediately input.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An induction heating cooking device comprising:

a light source to emit light;

a light source cover to cover the light source and having a main slit to pass the light emitted from the light source;

a cooking panel of which at least a part is formed of a transparent material, a lower surface of the cooking panel being provided with a light-shielding layer which includes an auxiliary slit through which the light passed through the main slit passes; and an induction coil to generate a magnetic field, wherein the light emitted from the light source sequentially passes through the main slit and the auxiliary slit to form a flame image on a side of a cooking container on the cooking panel, a thickness of the main slit determines a height of the flame image, and a thickness of the auxiliary slit is greater than the thickness of the main slit so that the light passing through the main slit is not blocked by the light-shielding layer.

2. The cooking device of claim 1, further comprising:

a screen fence provided on an upper surface of the cooking panel to minimize the light source from being directly exposed to a visual field of a user through the auxiliary slit.

3. The cooking device of claim 2, wherein the screen fence is provided to extend outward from a vertical upper side of the auxiliary slit.

4. The cooking device of claim 1, wherein the light source cover includes a first cover portion formed outward from the main slit and a second cover portion formed inward from the main slit.

5. The cooking device of claim 4, wherein the second cover portion extends inward further than the auxiliary slit to prevent a component under the cooking panel from being exposed to an outside through the auxiliary slit.

6. The cooking device of claim 5, further comprising an induction coil supporter to support the induction coil, wherein a vertical gap is formed between the second cover portion and the induction coil supporter.

7. The cooking device of claim 6, wherein at least a part of the induction coil is accommodated in the vertical gap.

* * * * *